US010507665B2

(12) United States Patent
Takahashi et al.

(10) Patent No.: US 10,507,665 B2
(45) Date of Patent: Dec. 17, 2019

(54) LIQUID CARTRIDGE INCLUDING CIRCUIT BOARD SUPPORTED BY SUPPORT MEMBER

(71) Applicant: BROTHER KOGYO KABUSHIKI KAISHA, Nagoya-shi, Aichi-ken (JP)

(72) Inventors: Hiroaki Takahashi, Nagoya (JP); Kosuke Nukui, Nagoya (JP); Takahiro Miyao, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/119,106

(22) Filed: Aug. 31, 2018

(65) Prior Publication Data

US 2019/0299634 A1 Oct. 3, 2019

(30) Foreign Application Priority Data

Mar. 29, 2018 (JP) ..... 2018-064179

(51) Int. Cl.
*B41J 2/175* (2006.01)

(52) U.S. Cl.
CPC ..... *B41J 2/17526* (2013.01); *B41J 2/17553* (2013.01); *B41J 2/1752* (2013.01); *B41J 2/17503* (2013.01)

(58) Field of Classification Search
CPC .. B41J 2/17526; B41J 2/17553; B41J 2/1752; B41J 2/17503; B41J 2/17513
USPC ..... 347/85–87
See application file for complete search history.

(56) References Cited

U.S. PATENT DOCUMENTS 8,562,116 B2 * 10/2013 Kanbe ..... B41J 2/1752 347/84
9,108,416 B2 * 8/2015 Norikane ..... B41J 2/1752
9,550,366 B2 * 1/2017 Okazaki ..... B41J 2/17543
2014/0168324 A1 6/2014 Sasaki
2017/0085031 A1 3/2017 Ishizawa et al.
(Continued)

FOREIGN PATENT DOCUMENTS

JP 2013-49164 A 3/2013
JP 2014-117836 A 6/2014
JP 2017-56706 A 3/2017

OTHER PUBLICATIONS

Extended European Search Report issued in related European Patent Application No. 18192082.8, dated Jan. 25, 2019.

*Primary Examiner* — An H Do
(74) *Attorney, Agent, or Firm* — Merchant & Gould P.C.

(57) ABSTRACT

A liquid cartridge is configured to be inserted into an attachment portion of a printing device in an insertion direction and attached thereto in an upright posture. The liquid cartridge includes: a housing; a sealing member; a circuit board; and a support member. The housing includes: a liquid chamber; and a liquid passage. The sealing member is disposed in the liquid passage. The circuit board is positioned rearward in the insertion direction relative to the sealing member in the upright posture. The circuit board includes: a contact; and a memory. The contact of the cartridge is electrically connectable to a contact of the device. The memory is electrically connected to the contact of the cartridge. The support member supports the circuit board. The circuit board supported by the support member is resiliently movable upward and downward relative to the housing in the upright posture.

20 Claims, 17 Drawing Sheets

(56) References Cited

U.S. PATENT DOCUMENTS

| | | | |
|---|---|---|---|
| 2018/0178528 | A1 | 6/2018 | Nakazawa et al. |
| 2018/0178530 | A1 | 6/2018 | Kobayashi et al. |
| 2018/0215165 | A1 | 8/2018 | Hayashi et al. |

* cited by examiner

LIQUID CARTRIDGE INCLUDING CIRCUIT BOARD SUPPORTED BY SUPPORT MEMBER

CROSS REFERENCE TO RELATED APPLICATION

This application claims priority from Japanese Patent Application No. 2018-064179 filed Mar. 29, 2018. The entire content of the priority application is incorporated herein by reference.

TECHNICAL FIELD

The present disclosure relates to a liquid cartridge storing liquid therein, and a system including the liquid cartridge, and an attachment portion to which the liquid cartridge is attachable.

BACKGROUND

One conventional system known in the art includes an ink cartridge, and an inkjet recording device. The inkjet recording device includes an attachment portion, and the ink cartridge can be mounted into and extracted from the attachment portion. The attachment portion of the inkjet recording device includes contacts.

A circuit board may be provided at an ink cartridge. A memory is mounted on the circuit board for storing such information as a color and material composition of ink stored in the cartridge, a residual quantity of ink, and the like. Electrodes are also formed on the circuit board. Electrical connections are formed between the electrodes on the ink cartridge and the contacts in the attachment portion when the ink cartridge is mounted in the attachment portion, enabling the inkjet recording device to read information stored in the memory.

One concern is that the circuit board may become damaged due to contact with the attachment portion as the ink cartridge is being inserted into the attachment portion. To avoid this type of problem, the ink cartridge could be configured with a spring disposed between the back surface of the circuit board and a support part that supports the circuit board, enabling the circuit board to change position or orientation through deformation of the spring (see Japanese Patent Application Publication No. 2017-56706). With this construction, the spring can absorb any impacts on the circuit board as the ink cartridge is inserted into the attachment portion.

SUMMARY

However, since the circuit board is disposed on the downstream end in the insertion direction of the conventional cartridge described above, the circuit board becomes interposed in the insertion direction between the contacts in the attachment portion and the support part for supporting the circuit board when the cartridge is mounted in the attachment section. Consequently, a strong impact may still be transmitted to the circuit board when the circuit board contacts the attachment portion, despite provision of the spring.

In view of the foregoing, it is an object of the present disclosure to provide a liquid cartridge capable of reducing a potential for damage to a circuit board. It is another object of the present disclosure to provide a system including this liquid cartridge.

In order to attain the above and other objects, according to one aspect, the present disclosure provides a liquid cartridge configured to be inserted into an attachment portion of a printing device in an insertion direction crossing a gravitational direction and attached to the attachment portion in an upright posture, the attachment portion including a contact. The liquid cartridge includes: a housing; a sealing member; a circuit board; and a support member. The housing includes: a liquid chamber; and a liquid passage. The liquid chamber stores liquid therein. The liquid passage is in communication with the liquid chamber and extends forward in the insertion direction from the liquid chamber. The liquid passage has a front end in the insertion direction. An opening is formed in the front end. The sealing member is disposed in the liquid passage. The circuit board is positioned rearward in the insertion direction relative to the sealing member in the upright posture. The circuit board includes: a contact; and a memory. The contact of the cartridge faces at least upward in the upright posture. The contact of the cartridge is electrically connectable to the contact of the device. The memory is electrically connected to the contact of the cartridge. The support member supports the circuit board. The circuit board supported by the support member is resiliently movable upward and downward relative to the housing in the upright posture.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Hereinafter, an embodiment of the disclosure will be described in detail while referring to accompanying drawings. It would be apparent to those skilled in the art that the embodiment described below is merely an example of the present disclosure and modifications and variations may be made therein without departing from the scope of the disclosure.

<Overview of Printer 10>

Figure 1:
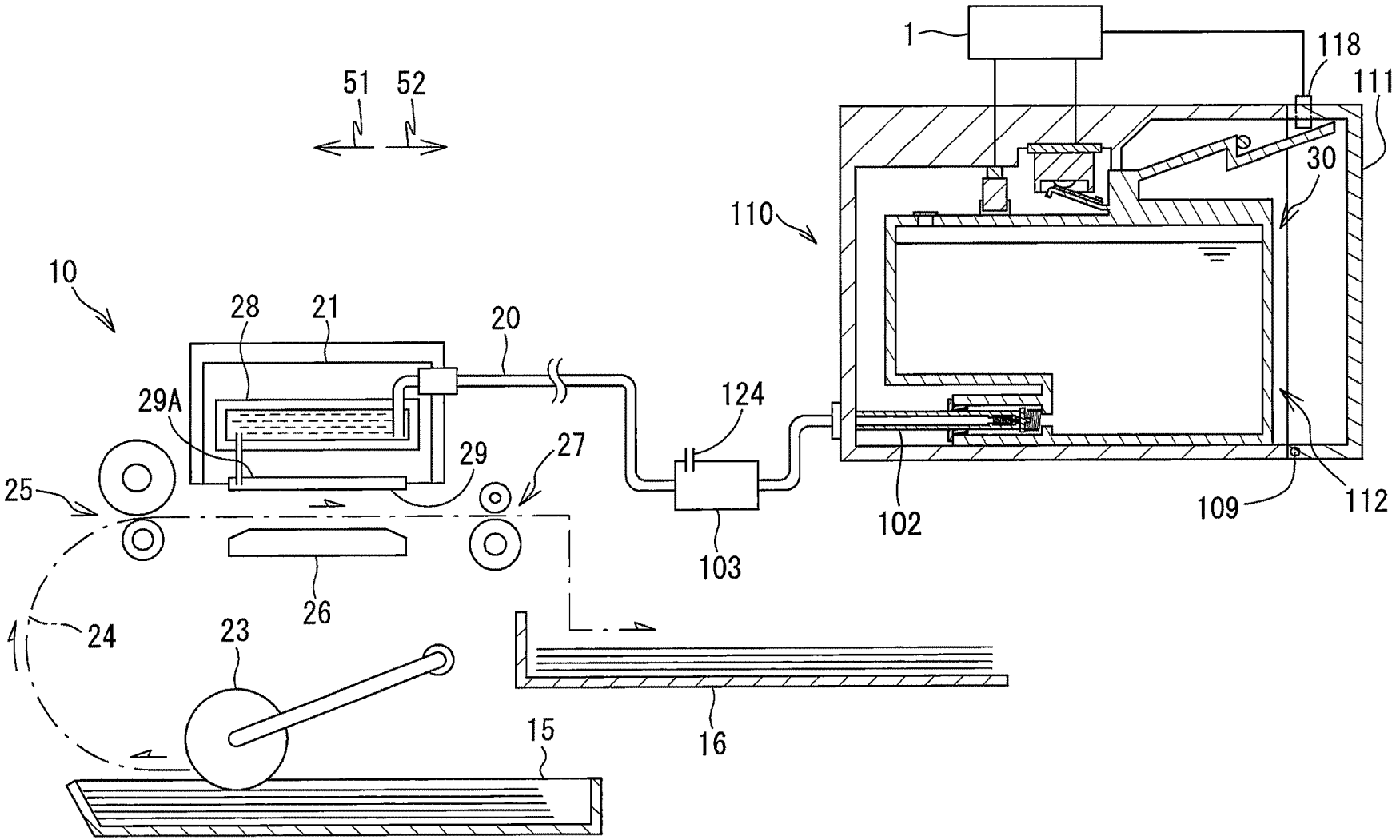
FIG. 1 is a vertical cross-sectional diagram schematically illustrating an internal structure of a printer according to an embodiment of the present disclosure.

As illustrated in FIG. 1, a printer 10 according to the embodiment is configured to record images on sheets of paper according to an inkjet recording method of ejecting ink droplets toward the sheets. The printer 10 includes a recording head 21, a cartridge-attachment portion 110, and ink tubes 20. Ink cartridges 30 storing ink to be supplied to the recording head 21 are detachably attachable to the cartridge-attachment portion 110. The ink tubes 20 connect the recording head 21 to the cartridge-attachment portion 110. An opening 112 is formed in one end of the cartridge-attachment portion 110. The ink cartridge 30 and the printer 10 constitute a system of the present disclosure.

Figure 9:
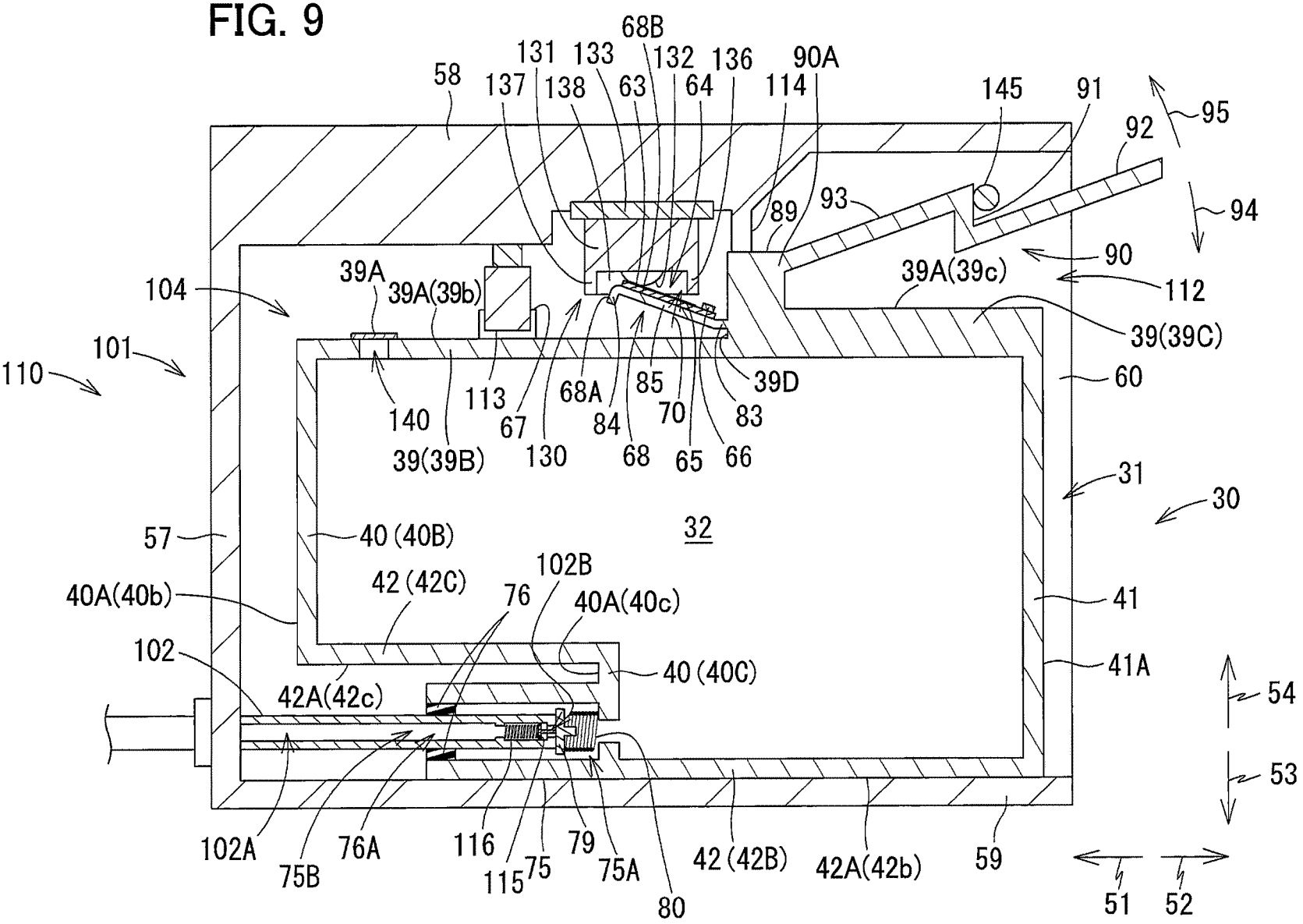
FIG. 9 is a vertical cross-sectional view of the ink cartridge according to the embodiment attached to the cartridge-attachment portion.

The ink cartridges 30 are inserted into the cartridge-attachment portion 110 through the opening 112 in order to be attached to the cartridge-attachment portion 110. The ink cartridges 30 are also extracted from the cartridge-attachment portion 110 through the opening 112. FIG. 1 illustrates one of the ink cartridges 30 in its attached state in the cartridge-attachment portion 110, i.e., when the ink cartridge 30 has been completely attached to the cartridge-attachment portion 110. FIG. 9 illustrates the ink cartridge 30 and cartridge-attachment portion 110 of FIG. 1. That is, FIG. 9 illustrates the attached state of the ink cartridge 30.

In the following description, as illustrated in FIG. 9, a frontward direction 51 is defined as a direction in which the ink cartridge 30 is inserted into the cartridge-attachment portion 110. Further, a posture of the ink cartridge 30 when being inserted forward into and attached to the cartridge-attachment portion 110 is defined as an upright posture. Hence, when in its attached state, the ink cartridge 30 is in the upright posture. FIGS. 1 and 4 through 9 illustrate the ink cartridge 30 in this upright posture. A rearward direction 52 is defined as a direction opposite the frontward direction 51, and is a direction in which the ink cartridge 30 is extracted from the cartridge attachment portion 110. In the present embodiment, a horizontal direction is defined as a direction orthogonal to the direction of gravity and parallel to the insertion direction. Both the frontward direction 51 and rearward direction 52 are parallel to the horizontal direction (direction orthogonal to the direction of gravity). The frontward direction 51 and rearward direction 52 intersect the direction of gravity. Further, a downward direction 53 is defined as the direction of gravity, and an upward direction 54 is defined as a direction opposite the direction of gravity. As illustrated in FIGS. 5A and 5B, a rightward direction 55 and a leftward direction 56 are defined as directions orthogonal to the frontward direction 51 and downward direction 53. More specifically, when the ink cartridge 30 is in its upright posture (the attached state illustrated in FIG. 1), the rightward direction 55 is defined as a direction extending rightward and the leftward direction 56 as a direction extending leftward when the ink cartridge 30 is viewed from the rear, as illustrated in FIG. 5B.

Further, in the following description, the frontward direction 51 and rearward direction 52 are collectively referred to as a front-rear direction, the upward direction 54 and downward direction 53 are collectively referred to as a vertical direction, and the rightward direction 55 and leftward direction 56 are collectively referred to as a left-right direction.

In the state where the ink cartridge 30 is completely attached to the cartridge-attachment portion 110, the ink cartridge 30 has a height in the vertical direction; a depth in the front-rear direction (i.e., insertion direction); and a width in the left-right direction (i.e., widthwise direction).

When the ink cartridge 30 is in its upright posture, the width direction of the ink cartridge 30 corresponds to the left-right direction, the height direction of the ink cartridge 30 corresponds to the vertical direction, and the depth direction of the ink cartridge 30 corresponds to the front-rear direction.

While in its upright posture, the ink cartridge 30 is inserted forward into the cartridge-attachment portion 110 through the opening 112 (see FIGS. 7 and 8) until the ink cartridge 30 is mounted in the cartridge-attachment portion 110 (see FIG. 9). The ink cartridge 30 is also extracted rearward from the cartridge-attachment portion 110 while in its upright posture.

The ink cartridge 30 stores ink that the printer 10 can use for printing. As illustrated in FIG. 1, the ink cartridge 30 is connected to the recording head 21 by the ink tube 20 when the ink cartridge 30 is in its attached state in the cartridge-attachment portion 110. The recording head 21 includes sub-tanks 28, and nozzles 29. Each of the sub-tanks 28 temporarily holds ink to be supplied through the corresponding ink tube 20. The recording head 21 ejects ink supplied from the sub-tanks 28 through the nozzles 29 according to an inkjet recording method. More specifically, the recording head 21 includes a head control board (not illustrated), and piezoelectric elements 29A corresponding one-on-one to the nozzles 29. The head control board selectively applies drive voltages to the piezoelectric elements 29A in order to eject ink from the nozzles 29.

The printer 10 also includes a sheet tray 15, a feed roller 23, a conveying path 24, a pair of conveying rollers 25, a platen 26, a pair of discharge rollers 27, and a discharge tray 16. The feed roller 23 feeds each of the sheets from the sheet tray 15 onto the conveying path 24, and the conveying rollers 25 convey the sheet over the platen 26. The recording head 21 ejects ink onto the sheet as the sheet passes over the platen 26, whereby an image is recorded on the sheet. The discharge rollers 27 receive the sheet that has passed over the platen 26 and discharge the sheet into the discharge tray 16 provided on the downstream end of the conveying path 24.

<Cartridge-Attachment Portion 110>

Figure 2:
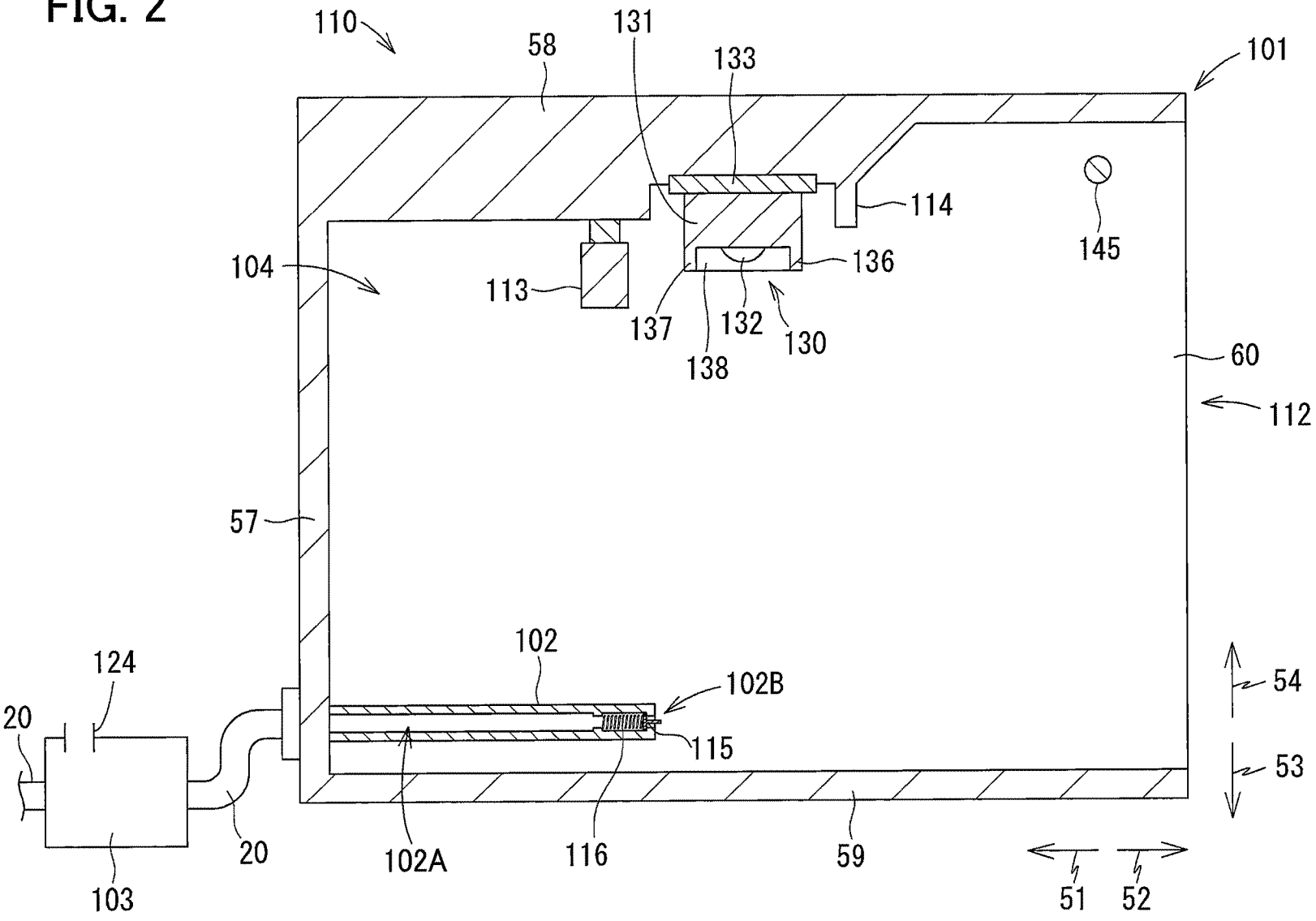
FIG. 2 is a vertical cross-sectional view of a cartridge-attachment portion according to the embodiment.

As illustrated in FIG. 2, the cartridge-attachment portion 110 includes a cartridge holder 101, tubes 102, a shaft 145, tanks 103, optical sensors 113, protruding part 114, and connectors 130.

<Cartridge Holder 101>

The cartridge holder 101 illustrated in FIG. 2 constitutes a casing of the cartridge-attachment portion 110. The cartridge holder 101 has a box shape. An interior space 104 is formed inside the cartridge holder 101.

As illustrated in FIG. 2, the cartridge holder 101 is provided with an end wall 57, a bottom wall 59, a top wall 58, and a pair of side walls 60. The bottom wall 59 extends rearward from the bottom edge of the end wall 57. The top wall 58 extends rearward from the top edge of the end wall 57 and is separated vertically from the bottom wall 59. The side walls 60 extend rearward from respective right and left edges of the end wall 57. The side wall 60 extending from the right edge of the end wall 57 is connected to right edges of the bottom wall 59 and top wall 58, while the side wall 60 extending from the left edge of the end wall 57 is connected to left edges of the bottom wall 59 and top wall 58. Hence, the side walls 60 connect the top wall 58 to the bottom wall 59.

The opening 112 is formed in the rear end of the cartridge holder 101 to oppose the end wall 57 in the front-rear direction. The opening 112 is in communication with the interior space 104 of the cartridge holder 101. A user faces the opening 112 when using the printer 10.

The interior space 104 of the cartridge holder 101 is defined by the end wall 57, bottom wall 59, top wall 58, and side walls 60. Partitioning walls (not illustrated) partition the interior space 104 into four compartments. One each of the tubes 102, tanks 103, optical sensors 113, protruding parts 114, and connector 130 is provided in each compartment of the partitioned interior space 104. Note that the number of compartments in the interior space 104 is not limited to four.

<Tubes 102>

The tube 102 illustrated in FIG. 2 is a cylindrically shaped member formed of a resin. As illustrated in FIG. 2, the tubes 102 are located in a lower portion of the end wall 57 constituting the cartridge holder 101. The tubes 102 protrude farther rearward than the end wall 57 of the cartridge holder 101. A rear end (distal end) and a front end (proximal end) of each tube 102 are both open.

The tube 102 has an interior space 102A. A valve 115 and a coil spring 116 are accommodated in the interior space 102A. By moving in the front-rear direction, the valve 115 opens and closes an opening 102B formed in the distal end of the tube 102. The coil spring 116 urges the valve 115 rearward. Hence, when an external force is not being applied to the valve 115 (when the ink cartridge 30 is not mounted in the cartridge-attachment portion 110), the valve 115 closes the opening 102B. Further, when an external force is not being applied to the valve 115, a rear end of the valve 115 urged by the coil spring 116 protrudes rearward from the opening 102B.

Notches (not illustrated) are formed in a peripheral wall of the tube 102 at the distal end thereof, and specifically in a portion of the peripheral wall positioned rearward from a part of the valve 115 that closes the opening 102B, i.e., a front end of the valve 115.

<Shaft 145>

As illustrated in FIG. 2, the shaft 145 extends in the left-right direction near the top wall 58 of the cartridge holder 101 and near the opening 112. The shaft 145 is a rod-shaped member that extends in the left-right direction through the interior space 104 of the cartridge holder 101. The shaft 145 is a metal rod, for example. Left and right ends of the shaft 145 are fixed to the side walls 60 of the cartridge holder 101.

<Cover 111>

As illustrated in FIG. 1, the cover 111 is provided near the opening 112 formed in the cartridge holder 101. The cover 111 is capable of covering the opening 112 or exposing the opening 112 to the outside by closing and opening on the cartridge holder 101. The cover 111 is supported on a pivot shaft 109 that extends in the left-right direction near a portion of the cartridge holder 101 defining a bottom edge of the opening 112. With this construction, the cover 111 is capable of pivoting from a closed position (see FIG. 1) for covering the opening 112 to an open position so that a top edge of the cover 111 moves forward. When the cover 111 is in the open position, the user can insert ink cartridges 30 into the cartridge holder 101 through the opening 112 formed in the cartridge holder 101. When the cover 111 is in the closed position, the user cannot insert ink cartridges 30 into or extract ink cartridges 30 from the cartridge holder 101.

<Tanks 103>

As illustrated in FIG. 2, the tanks 103 are provided frontward of the cartridge holder 101. Each tank 103 has a top portion that is open to the outside through an air communication port 124. Accordingly, the interior of the tank 103 is open to the atmosphere. The interior space in the tank 103 is in communication with the front end of the corresponding tube 102 via the corresponding ink tube 20. With this arrangement, ink flowing out of the interior space 102A of the tube 102 is accumulated in the tank 103. The interior space of the tank 103 is also in communication with the recording head 21 via the corresponding ink tube 20. Accordingly, ink stored in the interior of the tank 103 is supplied to the recording head 21 through the corresponding ink tube 20.

Note that the cartridge-attachment portion 110 need not be provided with the tanks 103. In this case, the front ends of the tubes 102 communicate with the recording head 21 via the ink tubes 20 without passing through the tanks 103.

<Optical Sensors 113>

As illustrated in FIG. 2, the optical sensors 113 are disposed near the top wall 58 of the cartridge holder 101. The optical sensors 113 are positioned farther forward than the shaft 145 in the front-rear direction. Each optical sensor 113 includes a light-emitting part and a light receiving part. The light-emitting part is disposed on the right or left of the light-receiving part with a gap formed therebetween. The light-emitting part is configured to emit light toward the light-receiving part in the left-right direction.

The optical sensors 113 are configured to output detection signals to a controller 1 (see FIG. 1). The signals differ according to whether the corresponding light-receiving part receives light emitted from the corresponding light-emitting part. For example, the optical sensor 113 outputs a low level signal to the controller 1 when the light-receiving part cannot receive light emitted from the light-emitting part (that is, when the received light is less than a prescribed intensity) and outputs a high level signal to the controller 1 when the light-receiving part can receive light emitted from the light-emitting part (that is, when the received light is greater than or equal to the prescribed intensity). Here, the controller 1 is a device for controlling operations of the printer 10 and is configured of a CPU, a ROM, and a RAM, for example.

<Cover Sensor 118>

The cover sensor 118 is disposed on the cartridge holder 101 near the top edge of the opening 112. The cover sensor 118 includes a light-emitting part and a light-receiving part. When the cover 111 is in the closed position, a part of the cover 111 is disposed in an optical path of the light traveling from the light-emitting part toward the light-receiving part, blocking the light from reaching the light-receiving part in the cover sensor 118. Accordingly, the cover sensor 118 outputs a low level signal to the controller 1. When the cover 111 is not in the closed position, that is, when the cover 111 is in a position separated from the cover sensor 118, the cover 111 does not interrupt light traveling from the light-emitting part to the light-receiving part, and the cover sensor 118 outputs a high level signal to the controller 1.

<Protruding Parts 114>

As illustrated in FIG. 2, the protruding parts 114 protrude downward from the top wall 58 of the cartridge holder 101. The protruding parts 114 are disposed rearward of the corresponding optical sensors 113 and forward of the shaft 145 in the front-rear direction.

<Connectors 130>

Figure 3A:
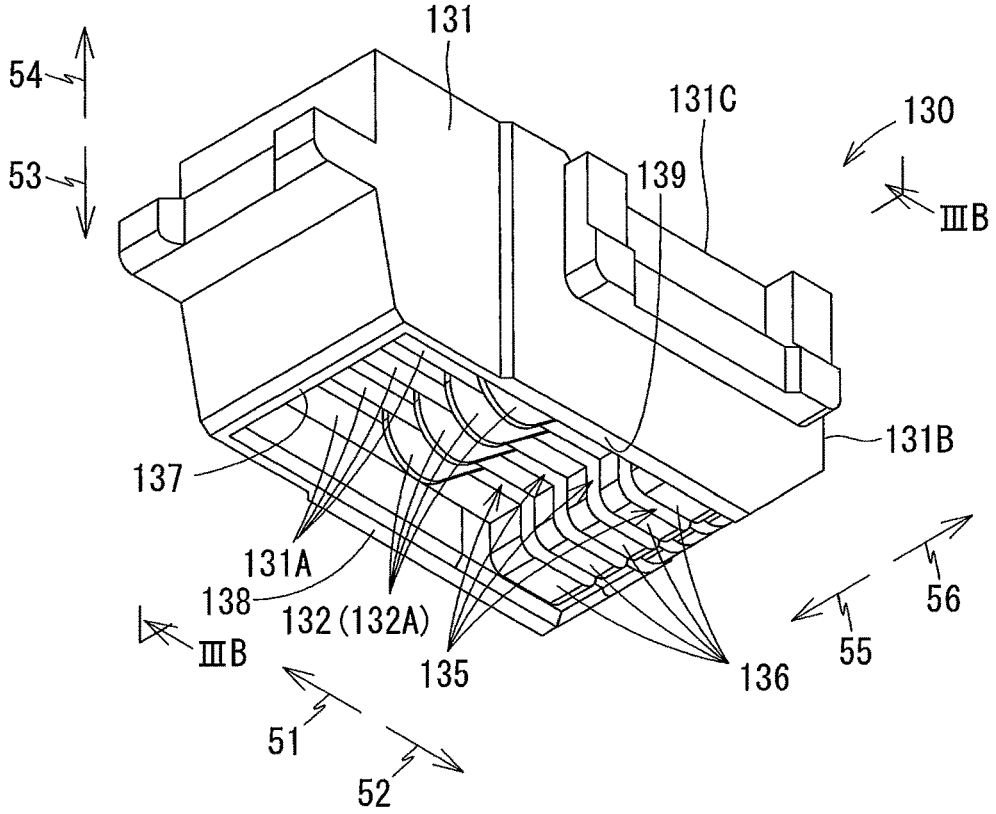
FIG. 3A is a perspective view of a connector of the cartridge-attachment portion according to the embodiment.
Figure 3B:
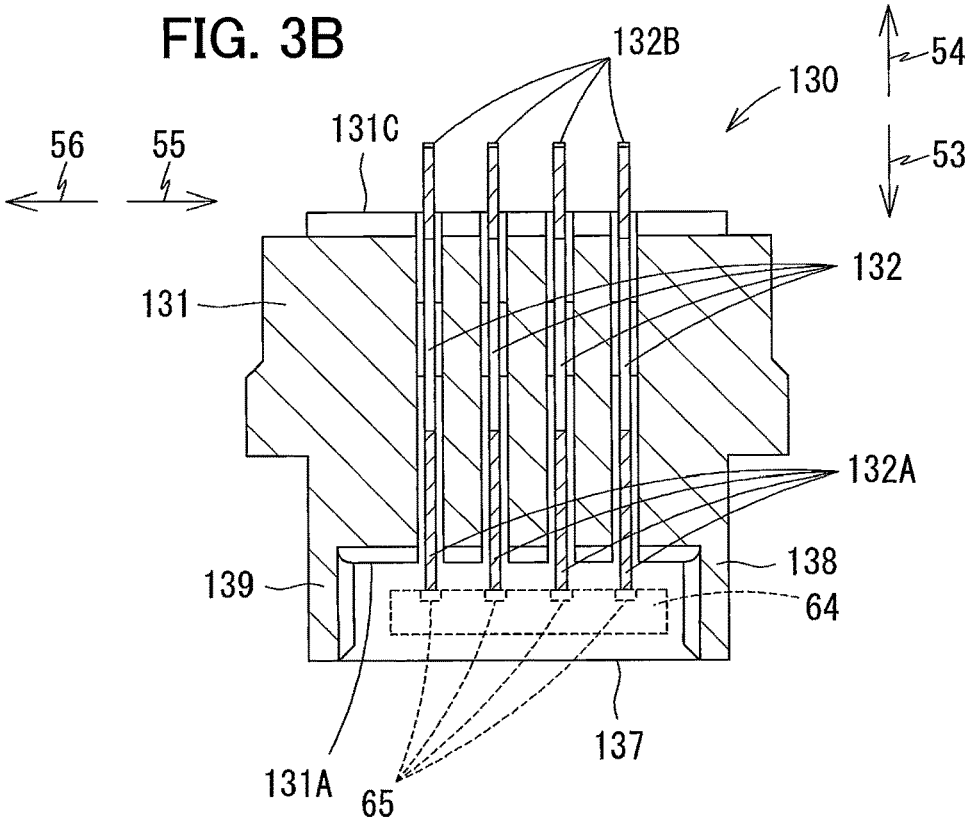
FIG. 3B is a cross-sectional view of the connector of the cartridge-attachment portion according to the embodiment taken along a plane IIIB-IIIB illustrated in FIG. 3A.

As illustrated in FIGS. 2, 3A and 3B, each of the connectors 130 includes contacts 132, and a case 131 accommodating the contacts 132.

As illustrated in FIG. 2, a circuit board 133 is fixed to the cartridge holder 101 in proximity to the top wall 58. The circuit board 133 is positioned farther rearward than the tubes 102 and optical sensors 113 and farther forward than the shaft 145 and protruding parts 114. The circuit board 133 is fixed to the cartridge holder 101. The cases 131 of the connectors 130 are fixed to a bottom surface of the circuit board 133 with screws, solder, or the like (not illustrated). Hence, the connectors 130 are fixed to the cartridge holder 101 via the circuit board 133. Note that the connectors 130 need not be fixed to the cartridge holder 101. For example, the connectors 130 may be removably fitted into or otherwise attached to the bottom surface of the circuit board 133.

As illustrated in FIGS. 3A and 3B, the case 131 of each connector 130 has a general rectangular parallelepiped shape. Slots 135 are formed in the case 131 from a bottom surface 131A to a top surface 131C. The slots 135 also pass through a rear surface 131B of the case 131. Four of the slots 135 are formed at intervals in the left-right direction. The four slots 135 provide four internal spaces in the case 131. A single contact 132 is disposed in each of the four internal spaces. Thus, the connector 130 includes four contacts 132. Note that the number of slots 135 is not limited to four. That is, the number of contacts 132 provided in the connector 130 is not limited to four.

The case 131 supports the contacts 132 in the corresponding internal spaces formed by the slots 135. The contacts 132 are configured of members that are flexible and electrically conductive. Bottom ends 132A of the contacts 132 protrude farther downward than the bottom surface 131A of the case 131. The bottom ends 132A of the contacts 132 can be elastically deformed upward.

Top ends 132B of the contacts 132 (see FIG. 3B) are mounted on the circuit board 133. Through this construction, the contacts 132 are electrically connected to an electric circuit mounted on the same circuit board 133. In other words, electricity can be conducted between the contacts 132 and the electric circuit. This electric circuit is also electrically connected to the controller 1 (see FIG. 1).

The case 131 also includes a rear wall 136, a front wall 137, a right wall 138, and a left wall 139. The rear wall 136, front wall 137, right wall 138, and left wall 139 protrude downward from the bottom surface 131A of the case 131. Bottom edges of the rear wall 136, front wall 137, right wall 138, and left wall 139 are thus positioned lower than bottom edges of the contacts 132.

The rear wall 136 is positioned farther rearward than the bottom ends 132A of the contacts 132. The front wall 137 is positioned farther forward than the bottom ends 132A of the contacts 132. The right wall 138 is positioned farther rightward than the bottom ends 132A of the contacts 132, and the left wall 139 is positioned farther leftward than the bottom ends 132A of the contacts 132. The right wall 138 and left wall 139 are aligned with each other in the left-right direction. A front edge of the right wall 138 is connected to a right edge of the front wall 137, and a rear edge of the right wall 138 is connected to a right edge of the rear wall 136. A front edge of the left wall 139 is connected to a left edge of the front wall 137, and a rear edge of the left wall 139 is connected to a left edge of the rear wall 136.

<Ink Cartridge 30>

Figure 4:
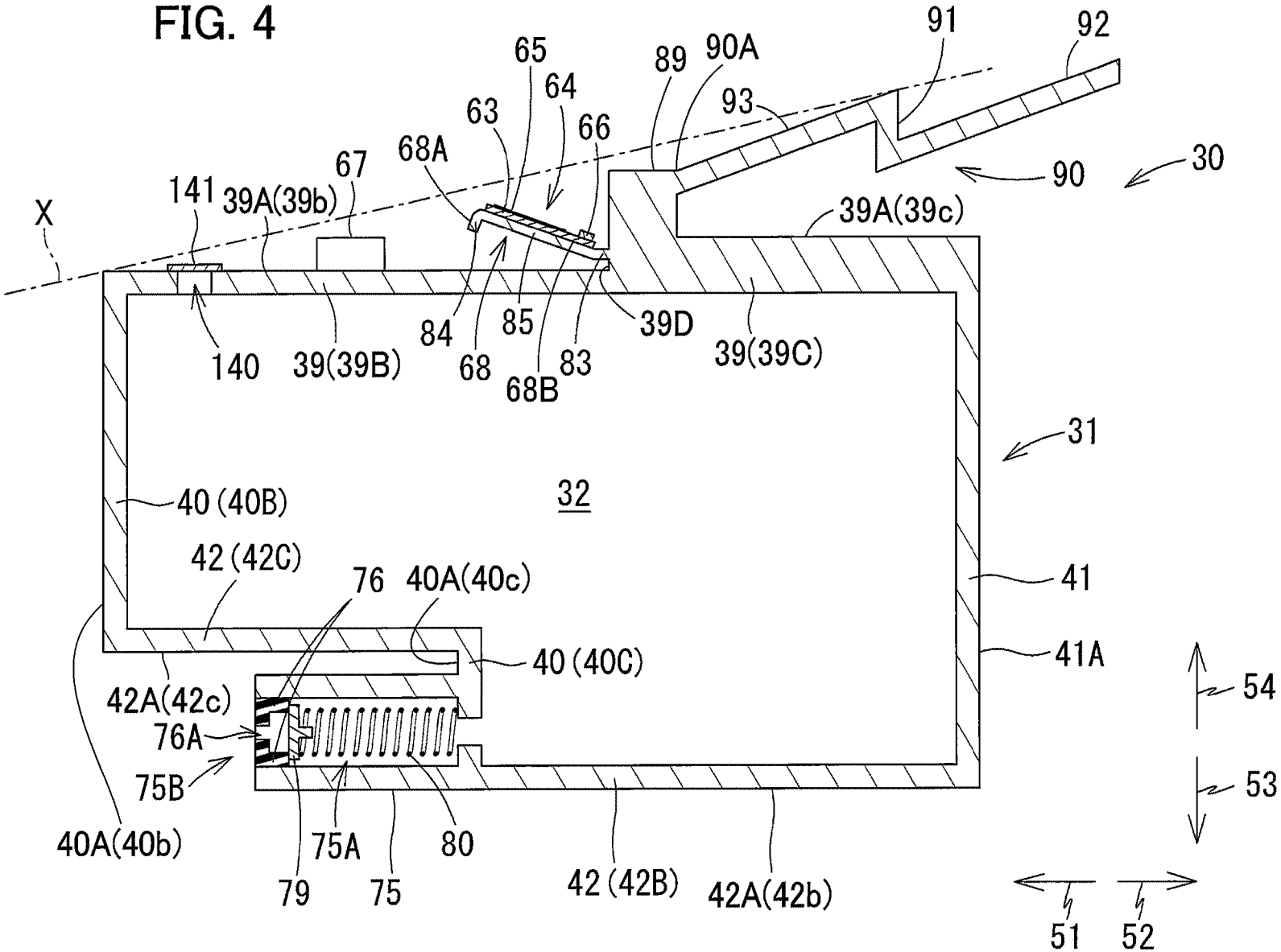
FIG. 4 is a vertical cross-sectional view of an ink cartridge according to the embodiment in an upright posture.
Figure 5B:
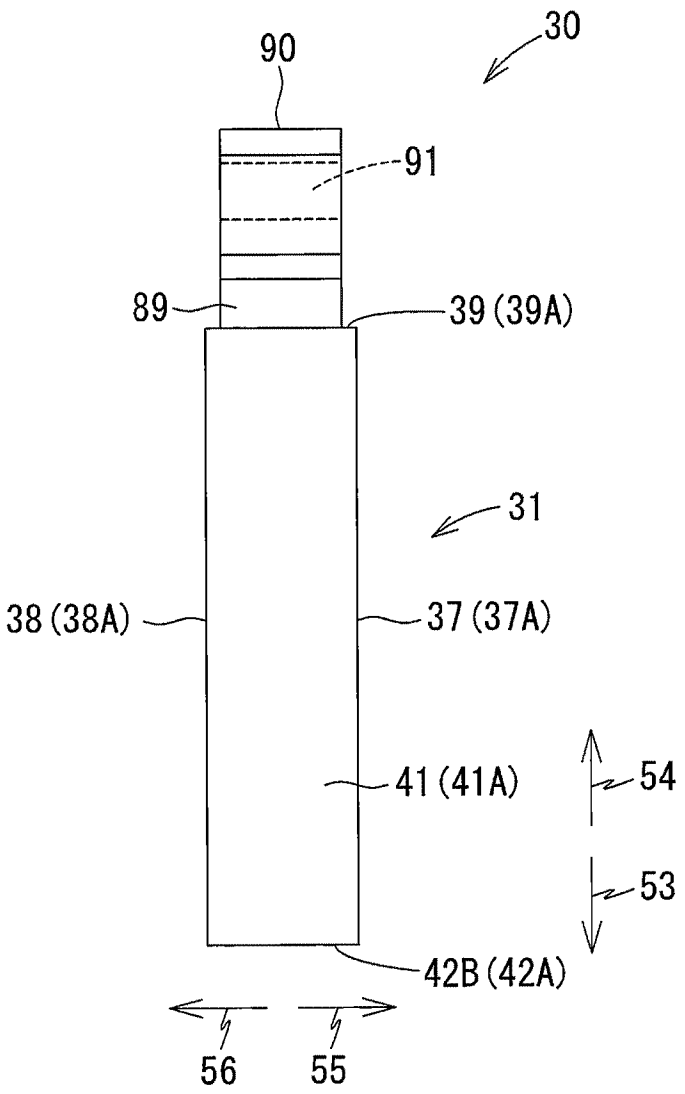
FIG. 5B is a rear side view of the ink cartridge according to the embodiment in the upright posture.
Figure 5A:
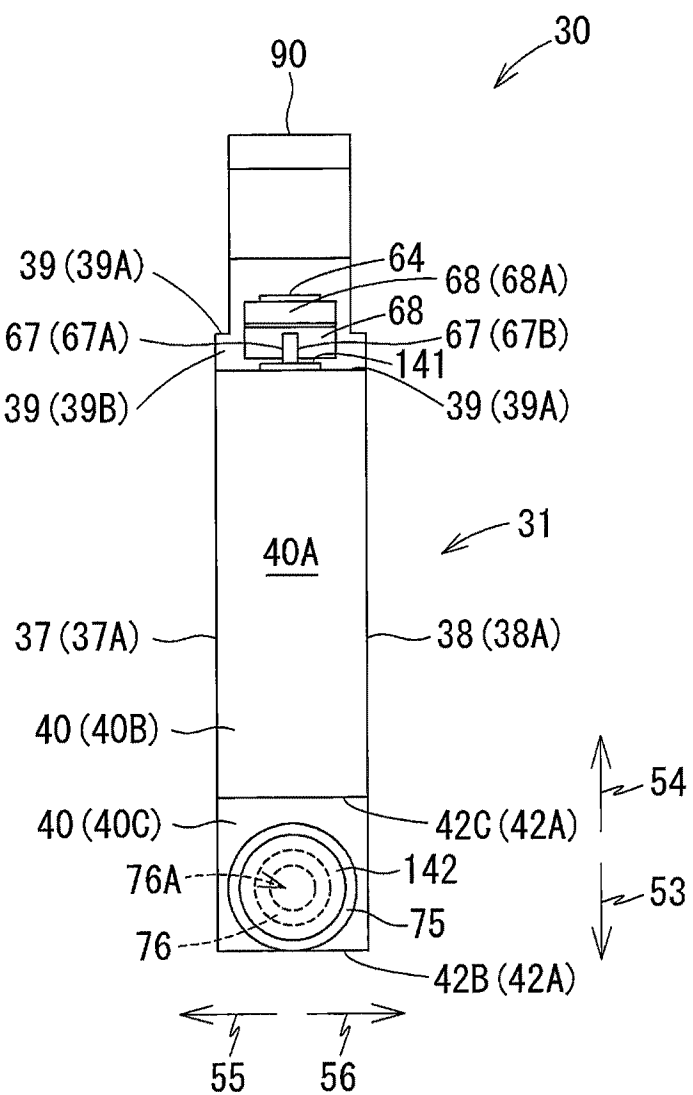
FIG. 5A is a front side view of the ink cartridge according to the embodiment in the upright posture.
Figure 6:
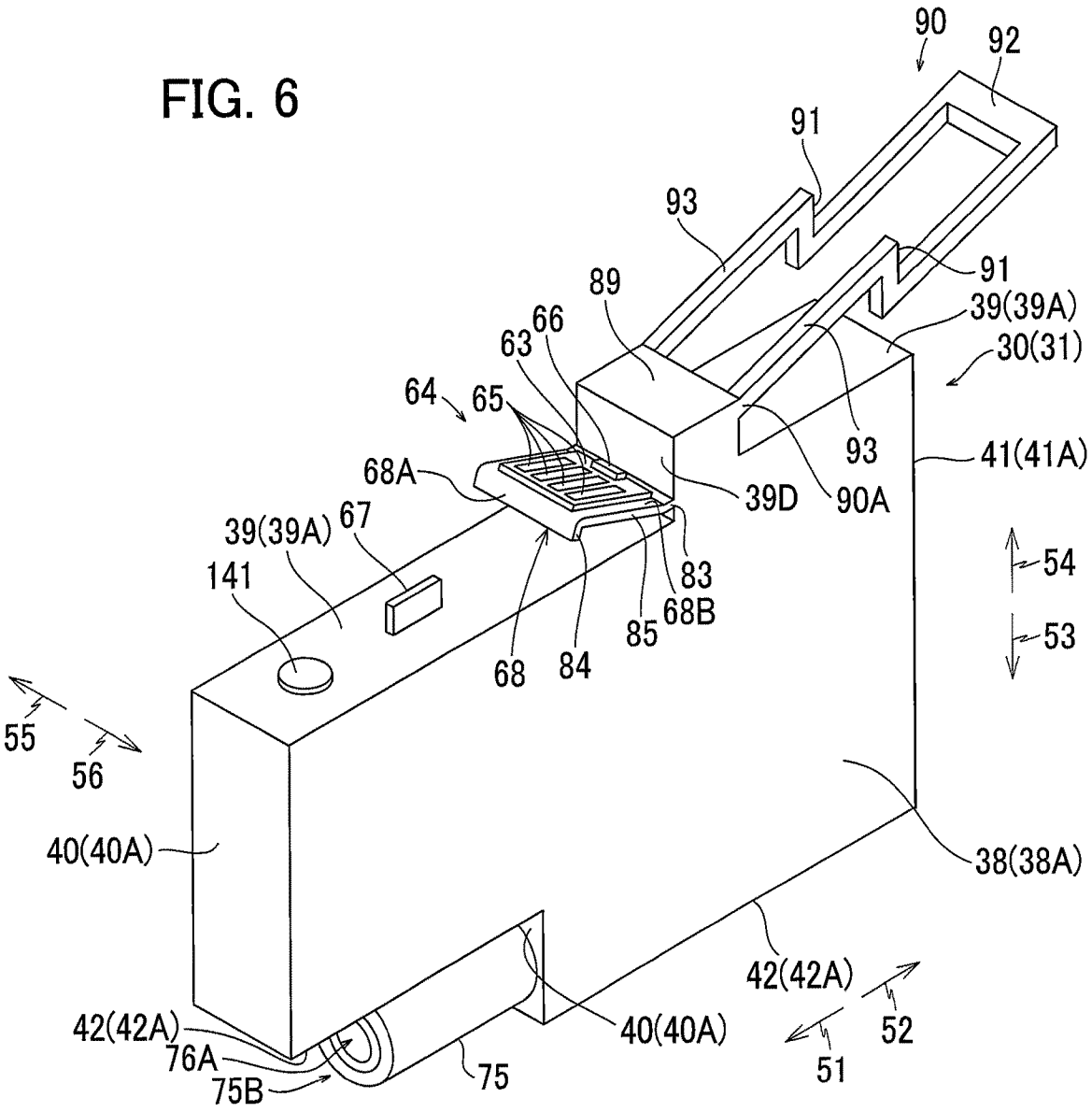
FIG. 6 is a perspective view of the ink cartridge according to the embodiment.

The ink cartridge 30 illustrated in FIGS. 4 to 6 is a container that stores ink. One ink cartridge 30 is accommodated in each of the four compartments partitioned in the interior space 104 of the cartridge holder 101 (see FIG. 2). Thus, four ink cartridges 30 can be accommodated in the cartridge-attachment portion 110 in the present embodiment. Each of the four ink cartridges 30 corresponds to one of the ink colors cyan, magenta, yellow, and black. Ink in one of these colors is stored in the corresponding ink cartridge 30. Note that the number of ink cartridges 30 that the cartridge-attachment portion 110 can accommodate is not limited to four.

As illustrated in FIGS. 4 to 6, the ink cartridge 30 includes a housing 31, a sealing member 76, a locking lever 90, a projection 67, and a circuit board 64.

<Housing 31>

The housing 31 is configured of a front wall 40, a rear wall 41, a top wall 39, a bottom wall 42, and a pair of side walls 37 and 38. The front wall 40 and rear wall 41 are separated from each other in the front-rear direction. The top wall 39 is arranged between the front wall 40 and rear wall 41 and extends from a top edge of the front wall 40 to a top edge of the rear wall 41. The bottom wall 42 is arranged between the front wall 40 and rear wall 41 and extends from a bottom edge of the front wall 40 to a bottom edge of the rear wall 41. The top wall 39 and bottom wall 42 are separated from each other in the direction of gravity. The side wall 37 and side wall 38 are separated from each other in the left-right direction. Peripheral edges of the side walls 37 and 38 are connected to the front wall 40, rear wall 41, top wall 39, and bottom wall 42.

In a state where the ink cartridge 30 is in its upright posture, a direction from the rear wall 41 to the front wall 40 is equivalent to the frontward direction 51, a direction from the front wall 40 to the rear wall 41 is equivalent to the rearward direction 52, a direction from the top wall 39 to the bottom wall 42 is equivalent to the downward direction 53, a direction from the bottom wall 42 to the top wall 39 is equivalent to the upward direction 54, a direction from the side wall 38 to the side wall 37 is equivalent to the rightward direction 55, and a direction from the side wall 37 to the side wall 38 is equivalent to the leftward direction 56. Also in this upright posture, a front surface 40A of the front wall 40 faces forward, a rear surface 41A of the rear wall 41 faces rearward, a bottom surface 42A of the bottom wall 42 faces downward, a top surface 39A of the top wall 39 faces upward, a right surface 37A of the side wall 37 faces rightward, and a left surface 38A of the side wall 38 faces leftward.

The front wall 40 is configured of a front wall 40B, and a front wall 40C positioned farther rearward than the front wall 40B. That is, a front surface 40*b* of the front wall 40B and a front surface 40*c* of the front wall 40C constitute the front surface 40A of the front wall 40. The bottom wall 42 is configured of a bottom wall 42B, and a bottom wall 42C positioned higher than the bottom wall 42B. A bottom surface 42*b* of the bottom wall 42B and a bottom surface 42*c* of the bottom wall 42C constitute the bottom surface 42A of the bottom wall 42. The bottom wall 42C extends continuously rearward from a bottom edge of the front wall 40B. The bottom wall 42B and bottom wall 42C are joined through the front wall 40C. The top wall 39 is configured of a top wall 39B, and a top wall 39C positioned higher than the top wall 39B. A top surface 39*b* of the top wall 39B and a top surface 39*c* of the top wall 39C constitute the top surface 39A of the top wall 39.

Unless otherwise specified, it will be assumed that the ink cartridge 30 is in its upright posture in the following description. In other words, the vertical, front-rear, and left-right directions for the ink cartridge 30 are defined on the basis of the ink cartridge 30 being in the upright posture.

The ink cartridge 30 has an overall flattened shape in which a left-right dimension thereof is smaller than a front-rear dimension thereof, and the vertical and front-rear dimensions are larger than the left-right dimension.

The ink cartridge 30 is mounted in the cartridge holder 101 by inserting the ink cartridge 30 forward through the opening 112 formed in the cartridge holder 101 of the cartridge-attachment portion 110 and is removed from the cartridge holder 101 by pulling the ink cartridge 30 rearward through the opening 112.

As illustrated in FIG. 4, the housing 31 defines therein a storage chamber 32 for storing ink. The storage chamber 32 is formed between the front wall 40 and rear wall 41, between the top wall 39 and bottom wall 42, and between the pair of side walls 37 and 38. In the present embodiment, the storage chamber 32 is defined by a surface of the front wall 40 opposite the front surface 40A (rear surface of the front wall 40), a surface of the rear wall 41 opposite the rear surface 41A (front surface of the rear wall 41), a surface of the top wall 39 opposite the top surface 39A (lower surface of the top wall 39), and a surface of the bottom wall 42 opposite the bottom surface 42A (upper surface of the bottom wall 42).

In the housing 31, at least the rear wall 41 has a light-transmission capability so that a level of ink stored in the storage chamber 32 is visible from the outside.

The housing 31 includes the cylinder 75 that protrudes forward from the front surface 40*c* of the front wall 40C. The cylinder 75 is elongated in the front-rear direction. A passage 75A extending in the front-rear direction is formed inside the cylinder 75. That is, the direction in which the cylinder 75 and passage 75A extend (front-rear direction) is aligned with the insertion direction of the ink cartridge 30. An opening 75B is formed in a front end of the cylinder 75 and in communication with the passage 75A. The passage 75A has a rear end in communication with the storage chamber 32. That is, the passage 75A is open at its rear end on the front surface 40*c* of the front wall 40C. In other words, the passage 75A is open frontward at the front wall 40. Hence, the passage 75A penetrates the front wall 40.

The passage 75A accommodates a valve 79, and a coil spring 80. The valve 79 opens and closes the opening 75B by moving in the front-rear direction. The coil spring 80 urges the valve 79 frontward. Therefore, when an external force is not applied to the valve 79, the valve 79 firmly contacts the sealing member 76 fitted in the opening 75B. However, when an external force is applied to the valve 79, the valve 79 separates from the sealing member 76, allowing ink stored in the storage chamber 32 to be supplied through the passage 75A and out through the opening 75B in the cylinder 75. Note that a structure for switching opening and closing of the opening 75B is not limited to the structure configured of the valve 79. For example, the opening 75B may be closed by a seal adhered to the cylinder 75.

An air communication port 140 is formed in the top wall 39 of the housing 31. A seal 141 seals the air communication port 140 prior to the ink cartridge 30 being inserted into the cartridge-attachment portion 110. The seal 141 can be peeled off the air communication port 140. By peeling the seal 141 off the air communication port 140 before inserting the ink cartridge 30 into the cartridge-attachment portion 110, the storage chamber 32 is able to communicate with the external air via the air communication port 140. Note that communication between the storage chamber 32 and external air may be achieved through means not involving peeling off the seal 141. For example, a valve may be provided in the air communication port 140, and the valve may be used to switch communication between the storage chamber 32 and the outside air on and off.

The front wall 40, rear wall 41, top wall 39, bottom wall 42, and side walls 37 and 38 may be configured of a plurality of walls in the same manner as the front wall 40 in the embodiment, or may be configured of single walls in the manner of the rear wall 41.

Further, the surfaces of the ink cartridge 30 including the front surface 40A of the front wall 40, rear surface 41A of the rear wall 41, top surface 39A of the top wall 39, bottom surface 42A of the bottom wall 42, right surface 37A of the side wall 37, and left surface 38A of the side wall 38 need not be formed as single flat surfaces.

The front surface 40A of the front wall 40 is a surface of the housing 31 that is visible when viewing the ink cartridge 30 in its upright posture from the front side. According to a concept of the present disclosure, a front surface includes: a surface of the housing 31 positioned farthest forward (the front surface 40*b*); and a surface of the housing 31 positioned forward of a halfway point in the front-rear direction between the forwardmost surface and a rearmost surface of the housing 31 (the front surface 40*c*).

The rear surface 41A of the rear wall 41 is a surface of the housing 31 that is visible when viewing the ink cartridge 30 in its upright posture from the rear side. The concept of a rear surface in the present disclosure includes: a surface of the housing 31 positioned farthest rearward (the rear surface 41A); and a surface positioned rearward of the halfway point in the front-rear direction between the rearmost surface and the forwardmost surface of the housing 31.

The top surface 39A of the top wall 39 is a surface of the housing 31 that is visible when viewing the ink cartridge 30 in its upright posture from above. The concept of the top surface in the present disclosure includes: a topmost surface of the housing 31 (the top surface 39*c*); and a surface above a vertical halfway point between this topmost surface and a bottommost surface of the housing 31 (the top surface 39*b*).

The bottom surface 42A of the bottom wall 42 is a surface of the housing 31 that is visible when viewing the ink cartridge 30 in its upright posture from below. The concept of the bottom surface in the present disclosure includes: the bottommost surface of the housing 31 (the bottom surface 42*b*); and a surface below the vertical halfway point between this bottommost surface and the topmost surface of the housing 31 (the bottom surface 42*c*).

The right surface 37A of the side wall 37 is a surface of the housing 31 that is visible when viewing the ink cartridge 30 in its upright posture from the right side.

The left surface 38A of the side wall 38 is a surface of the housing 31 that is visible when viewing the ink cartridge 30 in its upright posture from the left side.

<Sealing Member 76>

The sealing member 76 illustrated in FIGS. 4 and 5A is configured of an elastic member formed of rubber or the like. The sealing member 76 is a ring-shaped member with a circular through-hole 76A formed in a center thereof. The through-hole 76A has a diameter smaller than an outer diameter of the tube 102 in the cartridge-attachment portion 110 (see FIG. 2). As illustrated in FIG. 4, the sealing member 76 is disposed near the opening 75B of the passage 75A of the cylinder 75 so that the through-hole 76A is at the same position as the opening 75B in the front-rear direction. The sealing member 76 has an outer diameter larger than a diameter of the opening 75B. Accordingly, when the sealing member 76 is fitted into the opening 75B, a hermetic seal is formed between the sealing member 76 and the cylinder 75 to provide a light-tight seal therebetween.

The sealing member 76 is prevented from coming out of the cylinder 75 by well-known means. For example, the sealing member 76 may be fixed in the cylinder 75 by interposing the sealing member 76 between the cylinder 75 and a cap (not illustrated) placed over the cylinder 75, or may be fixed in the cylinder 75 by adhesive.

<Locking Lever 90>

As illustrated in FIGS. 4 and 6, a protruding part 89 is formed on the top surface 39A of the top wall 39. The protruding part 89 is provided on the rear portion of the top surface 39A, i.e., the top surface 39*c*, and protrudes upward therefrom. The locking lever 90 is provided on the top portion of the protruding part 89 and extends diagonally upward and rearward from the top portion of the protruding part 89. The locking lever 90 is provided with a contact surface 93, an engaging surface 91, and an operating part 92. The contact surface 93 is a surface extending upward and rearward from the proximal end 90A of the locking lever 90. The engaging surface 91 is a surface that extends vertically at a position in the front-rear center of the locking lever 90. The operating part 92 is provided on the rear end of the locking lever 90. The rear edge of the operating part 92 is farther rearward than the rear wall 41 of the housing 31.

The locking lever 90 can be elastically deformed in a direction indicated by an arrow 94 (see FIG. 7) about a connecting portion between the protruding part 94 and locking lever 90 (the proximal end 90A of the locking lever 90) by operating the operating part 92. Note that the locking lever 90 may extend directly from the top surface 39A of the top wall 39.

<Projection 67>

As illustrated in FIG. 4, the projection 67 is provided on the top surface 39A of the top wall 39. The projection 67 protrudes upward from the top surface 39A and is elongated in the front-rear direction. The projection 67 is positioned forward of the protruding part 89. Specifically, the projection 67 is provided on the top surface 39*b* of the top wall 39. When viewed in the left-right direction, the projection 67 is positioned lower than a virtual plane X that is the highest among virtual planes passing through the upper-front corner of the housing 31 and the locking lever 90.

Light emitted by the optical sensor 113 of the cartridge-attachment portion 110 (see FIG. 2) is incident on either a right surface or a left surface of the projection 67. The surface of the projection 67 on which light is incident will be called a light-blocking surface serving as a light-blocking part. In the present embodiment, the projection 67 is a plate formed of a resin material that contains a color material (black pigment) capable of blocking or attenuating light, for example. As a variation, a material that prevents the passage of light such as aluminum foil may be affixed to at least the irradiated surface of the projection 67. In this case, the material affixed to the irradiated surface serves as the light-blocking part.

<Leaf Spring 68>

As illustrated in FIG. 4, a stepped surface 39D that connects top surfaces 39*b* and 39*c* of different heights is provided on the top wall 39 between the protruding part 89 and projection 67. The top surface 39*c* positioned rearward of the stepped surface 39D is higher than the top surface 39*b* positioned forward of the stepped surface 39D. The stepped surface 39D faces forward.

The leaf spring 68 is positioned above the top surface 39*b*. The leaf spring 68 faces at least in the upward direction. More specifically, the leaf spring 68 extends diagonally upward and forward from the stepped surface 39D. The distal edge (front edge) of the leaf spring 68 is positioned to the rear of the projection 67.

The leaf spring 68 has a proximal end 83, a distal end 84 on the opposite end from the proximal end 83, and an intermediate part 85 between the proximal end 83 and distal end 84. The proximal end 83 is connected to the stepped surface 39D and extends forward therefrom. The intermediate part 85 extends diagonally upward and forward from the front edge of the proximal end 83. The distal end 84 extends diagonally downward and forward from the front edge of the intermediate part 85. Thus, the distal end 84 is on the opposite end of the intermediate part 85 from the proximal end 83 relative to the front-rear direction. A sloped surface 68A is formed on the distal end 84. The sloped surface 68A faces diagonally upward and forward. The intermediate part 85 of the leaf spring 68 has a sloped surface 68B that forms an acute angle with the top surface 39*b*.

Figure 7:
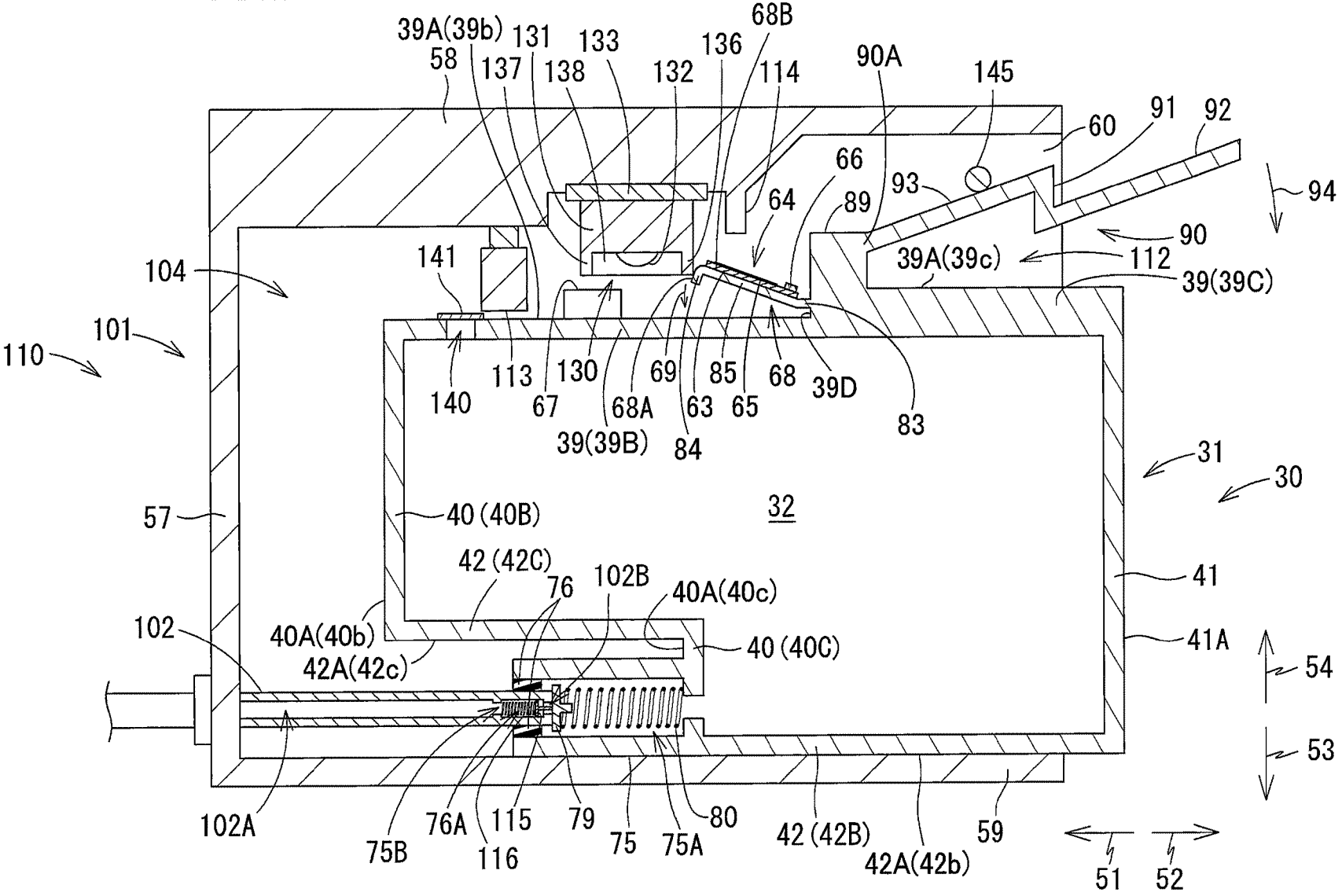
FIG. 7 is a vertical cross-sectional view of the ink cartridge according to the embodiment in the upright posture being inserted into the cartridge-attachment portion.

The leaf spring 68 can resiliently deform in directions along the direction of gravity, and specifically in directions indicated by an arrow 69 in FIG. 7 and an arrow 70 in FIG. 9.

<Circuit Board 64>

As illustrated in FIG. 4, the circuit board 64 is provided with a substrate 63, a memory 66, and electrodes 65. The circuit board 64 is supported from below by the leaf spring 68. The circuit board 64 is bonded to the sloped surface 68B on the intermediate part 85 of the leaf spring 68 with a photopolymer. However, the circuit board 64 may be bonded to the leaf spring 68 with an adhesive other than a photopolymer, or may be mounted on the leaf spring 68 by means other than adhesives, such as rivets. As described above, the leaf spring 68 is formed on the top surface 39A of the top wall 39, and more accurately on the stepped surface 39D. Accordingly, the circuit board 64 is disposed on the top surface 39A via the leaf spring 68.

As described above, the leaf spring 68 extends diagonally upward and forward. Hence, the circuit board 64 mounted on the top surface 68B of the leaf spring 68 also extends diagonally upward and forward. The circuit board 64 faces in at least the upward direction. In the present embodiment, the circuit board 64 (and specifically the top surface of the circuit board 64) faces diagonally upward and rearward.

The circuit board 64 is positioned both higher and farther rearward than the valve 79, coil spring 80, and projection 67. The circuit board 64 is also positioned farther rearward than the sealing member 76. More specifically, the circuit board 64 is positioned farther rearward than the through-hole 76A of the sealing member 76. The circuit board 64 is also positioned farther forward than the locking lever 90. The circuit board 64 is also positioned lower than the virtual plane X described above in the vertical direction.

The substrate 63 of the circuit board 64 is formed of silicon, glass epoxy or the like. The circuit board 64 is configured by mounting the memory 66 on the substrate 63 and forming four electrodes 65 on the substrate 63 (see FIG. 3B). The substrate 63 may be a flexible substrate. The number of electrodes 65 is determined in accordance with the number of the contacts 132 in the cartridge-attachment portion 110 (see FIG. 2) and is not limited to four.

The memory 66 is mounted on the top surface or the bottom surface of the substrate 64 (in the present embodiment, on the top surface of the substrate 64). The memory 66 stores information related to the ink cartridge 30 that can be read by the controller 1 of the printer 10. The information related to the ink cartridge 30 is data specifying a lot number, a manufactured date, an ink color, and the like. The memory 66 may be a semiconductor memory, such as a Static RAM (SRAM). Note that an integrated circuit (IC) providing function(s) other than a memory may also be mounted on the substrate 63, if necessary.

As illustrated in FIG. 3B, each of the four electrodes 65 corresponds to one of the four contacts 132 in the cartridge-attachment portion 110. Hence, the number of electrodes 65, as with the number of contacts 132, is not limited to four. The four electrodes 65 are exposed on the top surface of the substrate 63, allowing for electrical connections. Each electrode 65 is elongated in the front-rear direction. The electrodes 65 are arranged parallel to each other and are spaced apart from each other in the left-right direction on the top surface of the substrate 63. Each electrode 65 is electrically connected to the memory 66.

As described above, the circuit board 64 extends diagonally upward and forward. Accordingly, the electrodes 65 slope relative to the front-rear direction so as to face in a direction diagonally upward and rearward.

As described above, the circuit board 64 is bonded to the top surface 68B of the leaf spring 68. Hence, the entire area of the electrodes 65 overlaps the leaf spring 68 when viewed along the direction of gravity. That is, each of the electrodes 65 is aligned with the leaf spring 68 in the direction of gravity.

<Operations for Attaching the Ink Cartridge 30 to the Cartridge-Attachment Portion 110>

Next, operations for mounting the ink cartridge 30 in the cartridge holder 101 of the cartridge-attachment portion 110 will be described.

FIG. 4 illustrates the ink cartridge 30 prior to being mounted in the cartridge-attachment portion 110. At this time, the seal 141 seals the air communication port 140 so that the storage chamber 32 is not in communication with the atmosphere. Prior to mounting the ink cartridge 30 in the cartridge-attachment portion 110, the user peels off the seal 141, opening the storage chamber 32 to the atmosphere. Also, prior to the ink cartridge 30 being mounted in the cartridge-attachment portion 110, the valve 79 is in contact with the sealing member 76. Consequently, ink stored in the storage chamber 32 is prevented from flowing out of the ink cartridge 30 through the through-hole 76A.

In a state where the ink cartridge 30 is not attached to the cartridge-attachment portion 110, no member is positioned between the light-emitting part and light-receiving part of the optical sensor 113, enabling light to travel from the light-emitting part to the light-receiving part. At this time, the optical sensor 113 outputs a high level detection signal to the controller 1 (see FIG. 1). Further, prior to attachment of the ink cartridge 30 to the cartridge-attachment portion 110, the valve 115 closes the opening 102B, and the rear end of the valve 115 protrudes rearward from the opening 102B.

In order to attach the ink cartridge 30 to the cartridge-attachment portion 110, the ink cartridge 30 is inserted forward into the cartridge holder 101 through the opening 112 of the cartridge-attachment portion 110 (see FIG. 7).

As the ink cartridge 30 is inserted forward into the cartridge holder 101, as illustrated in FIG. 7, the tube 102 of the cartridge-attachment portion 110 is inserted into the passage 75A of the cylinder 75 through the through-hole 76A formed in the sealing member 76 (the opening 75B). At this time, the outer circumferential surface of the tube 102 closely contacts an inner circumferential surface of the sealing member 76 (the surface defining the through-hole 76A). This configuration not only fixes the position of the cylinder 75 when the ink cartridge 30 is in its attached state, but also forms a liquid-tight seal between the cylinder 75 and tube 102 that prevents ink from leaking into the cartridge holder 101.

The tube 102 inserted into the passage 75A also contacts and pushes the valve 79 rearward. Through this action, the valve 79 is separated from the sealing member 76 against a forward urging force of the coil spring 80.

Further, when the distal end of the tube 102 contacts the valve 79, the valve 79 contacts the valve 115 from the rear side thereof and pushes the valve 115 forward. Consequently, the valve 115 moves forward against the urging force of the coil spring 116. This action allows the interior space 102A of the tube 102 to communicate with the exterior of the tube 102 through the opening 102B.

As a result, ink stored in the storage chamber 32 can flow into the tank 103 and recording head 21 via the interior space 102A of the tube 102. At this time (in the state illustrated in FIG. 7), the circuit board 64 is not yet in contact with the cartridge-attachment portion 110.

Also, when the ink cartridge 30 is being inserted forward into the cartridge holder 101, as illustrated in FIG. 7, the contact surface 93 formed on the locking lever 90 of the ink cartridge 30 contacts the shaft 145 from the rear side. The shaft 145 is guided along the contact surface 93. Through the process of guiding the shaft 145, the locking lever 90 elastically deforms in the direction indicated by an arrow 94 in FIG. 7, in response to a reaction force from the shaft 145.

Also, when the ink cartridge 30 is being inserted forward into the cartridge holder 101, as illustrated in FIG. 7, the sloped surface 68A formed on the leaf spring 68 of the ink cartridge 30 contacts the rear wall 136 of the connector 130 in the cartridge-attachment portion 110 from the lower-rear side thereof. The rear wall 136 is guided along the sloped surface 68A. After passing over the sloped surface 68A, the rear wall 136 is guided along the sloped surface 68B of the leaf spring 68 and the circuit board 64 (see FIG. 8). Through the process of guiding the rear wall 136, the leaf spring 68 resiliently deforms in the direction of gravity, and specifically in the direction indicated by the arrow 69 in FIG. 7, in response to the reaction force from the rear wall 136. Consequently, the circuit board 64 moves in the direction of gravity relative to the housing 31 of the ink cartridge 30. More specifically, as the ink cartridge 30 is being inserted, the leaf spring 68 moves forward while being pushed downward by the rear wall 136 of the connector 130. Thus, the circuit board 64 slides along the rear wall 136 while passing beneath the same. Once the front end of the leaf spring 68 has passed under the rear wall 136, the leaf spring 68 begins to return resiliently to its original position (its position prior to being pushed downward by the rear wall 136) and approaches the contacts 132. This action brings the electrodes 65 on the circuit board 64 into contact with the bottoms of the corresponding contacts 132.

Figure 8:
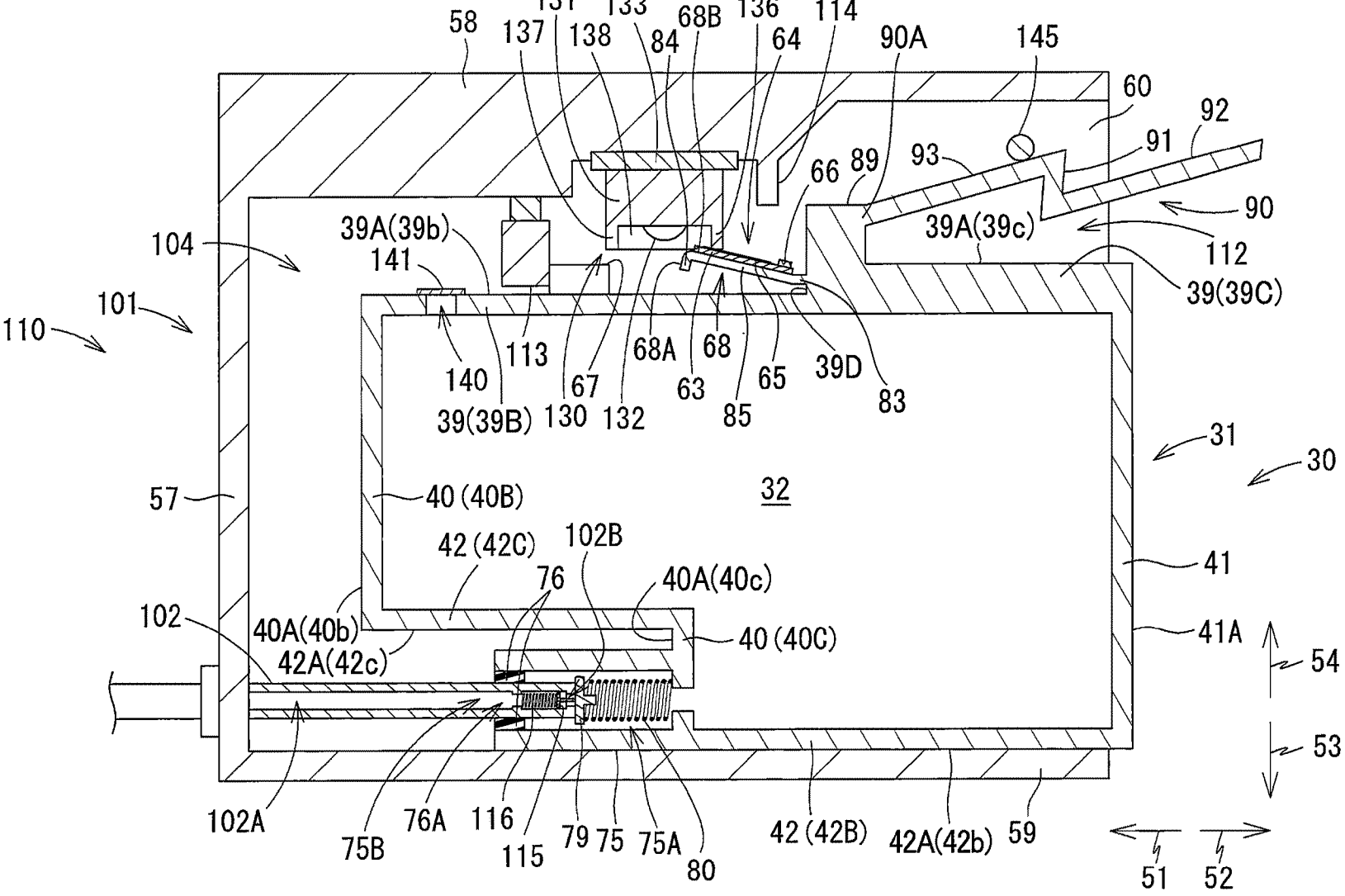
FIG. 8 is a vertical cross-sectional view of the ink cartridge according to the embodiment in the upright posture being further inserted into the cartridge-attachment portion than in FIG. 7.

When the ink cartridge 30 is inserted into the cartridge holder 101 further forward than in a state illustrated in FIG. 8, the ink cartridge 30 assumes a state illustrated in FIG. 9, the state of the ink cartridge 30 at this time is the attached state. In the attached state, the mounting of the ink cartridge 30 to the cartridge holder 101 is completed. Next, states of components in the ink cartridge 30 and cartridge-attachment portion 110 while the ink cartridge 30 is in the attached state will be described.

As illustrated in FIG. 9, the tube 102 of the cartridge-attachment portion 110 has advanced into the passage 75A of the cylinder 75.

Also, as illustrated in FIG. 9, the contact surface 93 and engaging surface 91 formed on the locking lever 90 are positioned forward than the shaft 145. As a result, the locking lever 90 elastically returns to a direction indicated by an arrow 95 in FIG. 9. The engaging surface 91 of the elastically returned locking lever 90 is aligned with the shaft 145 in the front-rear direction. When the user releases user's hand from the ink cartridge 30, the ink cartridge 30 is moved rearward by the urging force of the coil spring 80. Hence, the engaging surface 91 contacts the shaft 145 from the front side thereof, thereby positioning the ink cartridge 30 in the front-rear direction in the cartridge holder 101.

Further, as illustrated in FIG. 9, the top portion of the protruding part 89 contacts the bottom surface of the protruding part 114 in the cartridge-attachment portion 110 from below. On the other hand, the bottom wall 42A of the ink cartridge 30 contacts the upper surface of the bottom wall 59 in the cartridge-attachment portion 110, thereby vertically positioning the ink cartridge 30 in the cartridge holder 101.

As illustrated in FIG. 9, the projection 67 is positioned between the light-emitting part and light-receiving part of the optical sensor 113. Consequently, the projection 67 blocks the progression of light from the light-emitting part to the light-receiving part. That is, the projection 67 is positioned in the optical path of light irradiated from the light-emitting part when the ink cartridge 30 is in the attached state. In other words, the optical sensor 113 is positioned such that the light-blocking surface of the projection 67 is in the optical path of light irradiated from the light-emitting part when the ink cartridge 30 is in the attached state. At this time, the optical sensor 113 outputs a low level detection signal to the controller 1 (see FIG. 1).

Further, the electrodes 65 of the circuit board 64 contact corresponding contacts 132.

With the four electrodes 65 contacting the corresponding contacts 132 so that electricity can be conducted therebetween, a voltage Vc is applied to the electrodes 65, the electrodes 65 are grounded, and power is supplied to the electrodes 65. Through this electrical connection between the contacts 132 and electrodes 65, the memory 66 mounted on the circuit board 64 is also electrically connected to the controller 1 (see FIG. 1). Consequently, the controller 1 can access the memory 66, enabling data stored in the memory 66 to be inputted into the controller 1 (see FIG. 1).

When the ink cartridge 30 is in the attached state illustrated in FIG. 9, the front wall 137 of the connector 130 is positioned frontward of the circuit board 64, and the rear wall 136 of the connector 130 is positioned rearward of the circuit board 64. Further, the bottom edges of the rear wall 136 and front wall 137 are positioned lower than the electrodes 65. With this arrangement, the electrodes 65 are interposed between the front wall 137 and rear wall 136 in the front-rear direction when the ink cartridge 30 is in the attached state. That is, the rear wall 136 and front wall 137 are juxtaposed in the front-rear direction with the electrodes 65 interposed therebetween.

As illustrated in FIG. 3B, the right wall 138 of the connector 130 is on the right side of the circuit board 64, and the left wall 139 of the connector is on the left side of the circuit board 64 when the ink cartridge 30 is in the attached state. Further, bottom edges of the right wall 138 and left wall 139 are positioned lower than the electrodes 65. With this configuration, the right wall 138 and left wall 139 enclose the electrodes 65 from the left and right sides when the ink cartridge 30 is in the attached state. That is, the right wall 138 and left wall 139 are juxtaposed in the left-right direction with the electrodes 65 interposed therebetween.

To extract the ink cartridge 30 from the cartridge holder 101 of the cartridge-attachment portion 110 in the state illustrated in FIG. 9, the user pushes the operating surface 92 downward. As a result, the locking lever 90 elastically deforms in the direction indicated by the arrow 94, thereby moving the engaging surface 91 to a position lower than the shaft 145. Consequently, the urging force of the coil spring 80 moves the ink cartridge 30 rearward relative to the cartridge holder 101. Through the above operation, the user can then remove the ink cartridge 30 from the cartridge-attachment portion 110.

<Detecting Attachment of the Ink Cartridge 30 to the Cartridge-Attachment Portion 110>

Next, operations for detecting when an ink cartridge 30 is inserted into the cartridge-attachment portion 110 will be described with reference to flowcharts illustrated in FIGS. 10 and 11.

Figure 10:
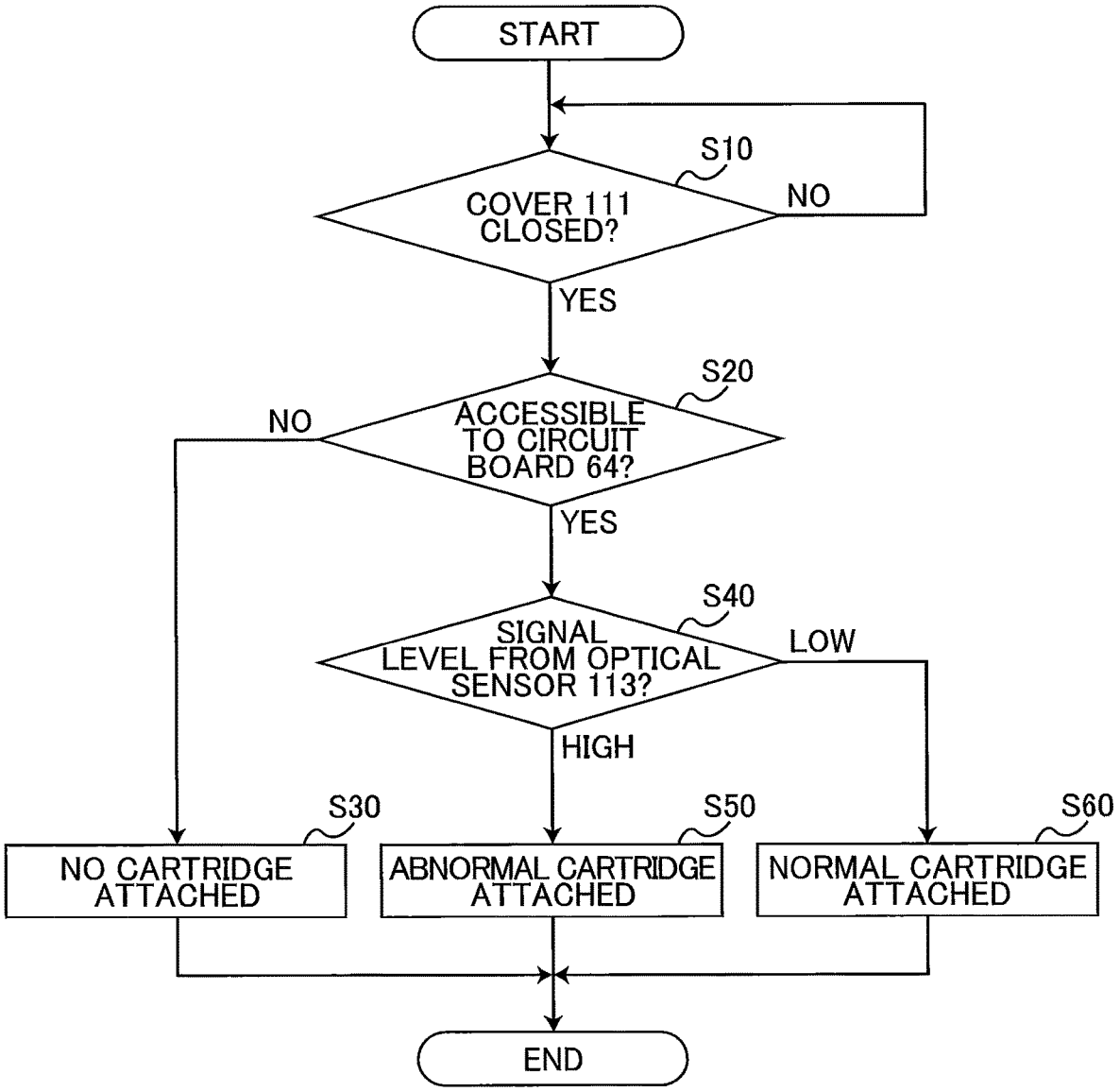
FIG. 10 is a flowchart illustrating steps to determine whether the ink cartridge according to the embodiment is attached to the cartridge-attachment portion.
Figure 11:
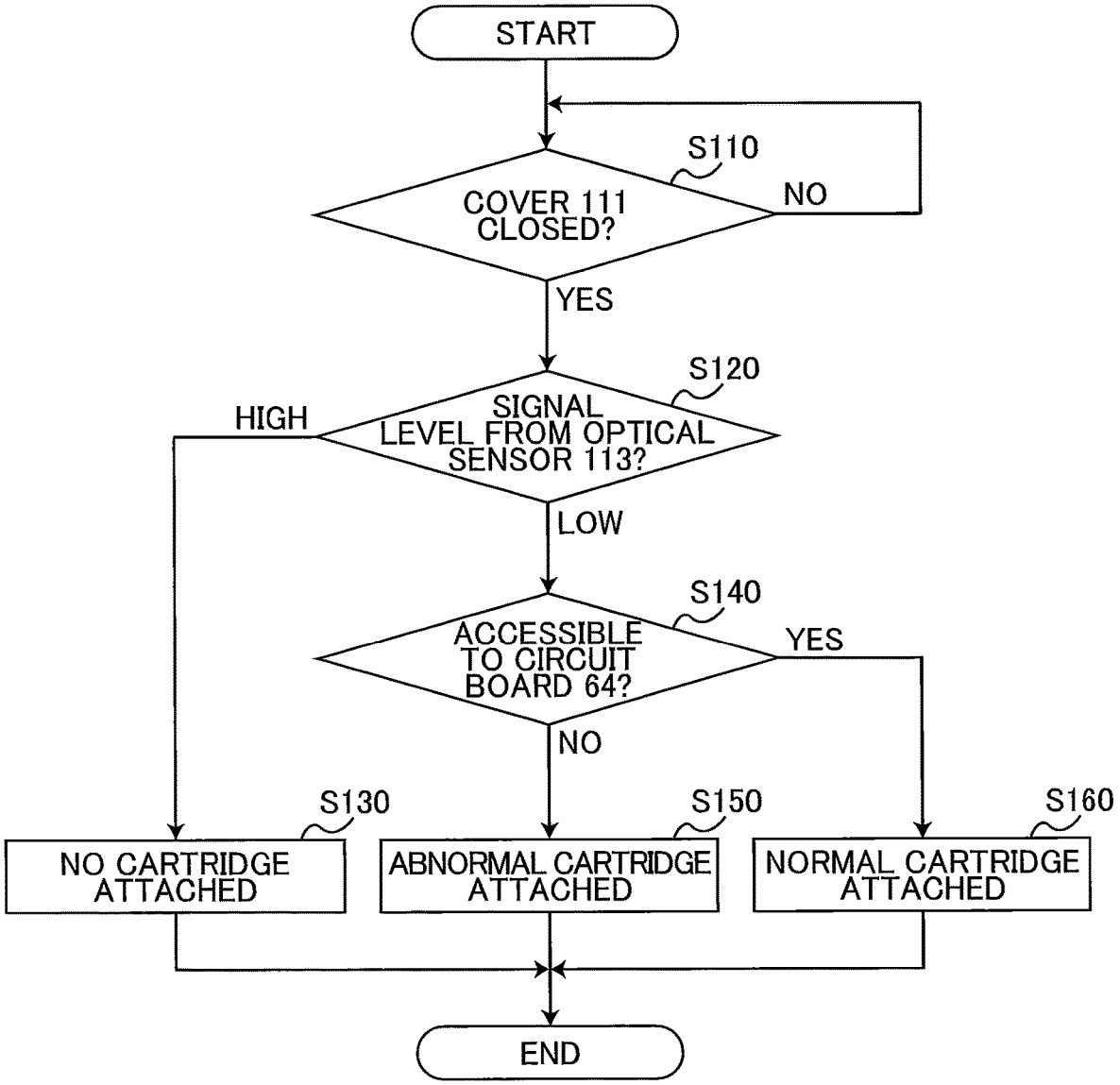
FIG. 11 is a flowchart illustrating another way of steps to determine whether the ink cartridge according to the embodiment is attached to the cartridge-attachment portion.

The flowcharts of FIGS. 10 and 11 are configured to be initiated when the cover 111 is opened by the user. That is, the controller 1 is configured to launch the flowchart of FIG. 10 or the flowchart of FIG. 11 in response to receiving a high level signal outputted from the cover sensor 118.

As illustrated in FIG. 10, in S10 the controller 1 (see FIG. 1) determines whether the cover 111 is in the closed position. The controller 1 determines that the cover 111 is in the closed position when the signal outputted from the cover sensor 118 changes to a low level signal.

In a case where the cover 111 is not in the closed position (S10: NO), the controller 1 repeats the determination in S10 until the cover 111 is determined to be closed, i.e., until the signal outputted from the cover sensor 118 changes from high level to low level.

When the cover 111 is determined to be in the closed position (S10: YES), in S20 the controller 1 determines whether the memory 66 on the circuit board 64 of the ink cartridge 30 is accessible, i.e., whether the controller 1 can read from or write to the memory 66. When the contacts 132 are in contact with and electrically connected to the electrodes 65 on the circuit board 64, the controller 1 is able to access the memory 66 on the circuit board 64. When the contacts 132 are not in contact with the electrodes 65 on the circuit board 64, the controller 1 cannot access the memory 66.

If the controller 1 cannot access the memory 66 (S20: NO), in S30 the controller 1 determines that an ink cartridge 30 is not mounted in the cartridge-attachment portion 110. In this case, the controller 1 notifies the user that an ink cartridge 30 is not mounted by displaying a message on a display panel (not illustrated) provided on a housing of the printer 10 and/or emitting a beep or other sound from a speaker (not illustrated).

However, when the controller 1 can access the circuit board 64 (S20: YES), in S40 the controller 1 determines whether the signal outputted from the optical sensor 113 to the controller 1 is high level or low level. When the projection 67 is positioned between the light-emitting part and light-receiving part of the optical sensor 113, the optical sensor 113 outputs a low level signal to the controller 1. When the projection 67 is not positioned between the light-emitting part and light-receiving part of the optical sensor 113, the optical sensor 113 outputs a high level signal to the controller 1.

When the signal outputted from the optical sensor 113 to the controller 1 is high level (S40: HIGH), in S50 the controller 1 determines that an abnormal ink cartridge 30 is attached to the cartridge-attachment portion 110. In this case, the controller 1 notifies the user that an abnormal ink cartridge 30 is mounted by displaying a message on the display panel (not illustrated) provided on the housing of the printer 10 and/or playing a beep or other sound from the speaker (not illustrated).

On the other hand, if the signal outputted by the optical sensor 113 is low level (S40: LOW), in S60 the controller 1 determines that a normal ink cartridge 30 is attached to the cartridge-attachment portion 110.

In the flowchart of FIG. 10, the controller 1 determines whether an ink cartridge 30 is mounted in the cartridge-attachment portion 110 on the basis of whether the circuit board 64 is accessible, and determines whether the ink cartridge 30 mounted in the cartridge-attachment portion 110 is normal on the basis of the level of the signal outputted from the optical sensor 113.

However, the controller 1 may be configured to determine whether an ink cartridge 30 is mounted in the cartridge-attachment portion 110 on the basis of the level of the signal outputted from the optical sensor 113 and to determine whether the ink cartridge 30 mounted in the cartridge-attachment portion 110 is normal on the basis of whether the circuit board 64 is accessible. Steps in this variation will be described next with reference to the flowchart in FIG. 11.

Referring to FIG. 11, the controller 1 first determines in S110 whether the cover 111 is in the closed position, as in the flowchart of FIG. 10. The controller 1 repeats the determination in S110 (S110: NO) until the cover 111 is determined to be in the closed position, i.e., until the signal outputted from the cover sensor 118 changes from high level to low level.

When the controller 1 determines in S110 that the cover 111 is in the closed position (S110: YES), in S120 the controller 1 determines whether the signal outputted from the optical sensor 113 to the controller 1 is high level or low level.

If the signal outputted by the optical sensor 113 is high level (S120: HIGH), in S130 the controller 1 determines that an ink cartridge 30 is not mounted in the cartridge-attachment portion 110. In this case, as in S30 of FIG. 10, the controller 1 notifies the user that an ink cartridge 30 is not mounted.

However, if the signal outputted by the optical sensor 113 is low level (S120: LOW), in S140 the controller 1 determines whether the circuit board 64 of the ink cartridge 30 is accessible.

If the controller 1 cannot access the circuit board 64 (S140: NO), in S150 the controller 1 determines that an abnormal ink cartridge 30 is mounted in the cartridge-attachment portion 110. In this case, as in S50 of FIG. 10, the controller 1 notifies the user that an abnormal ink cartridge 30 is mounted.

On the other hand, if the controller 1 can access the circuit board 64 (S140: YES), in S160 the controller 1 determines that a normal ink cartridge 30 is mounted in the cartridge-attachment portion 110.

<Operational and Technical Advantages of the Embodiment>

According to the present embodiment, the circuit board 64 is positioned farther rearward than the sealing member 76. Accordingly, there is a high probability that the sealing member 76 and its peripheral parts will contact the cartridge-attachment portion 110 before the circuit board 64 contacts the cartridge-attachment portion 110 when the ink cartridge 30 is inserted into the cartridge-attachment portion 110, thereby reducing the possibility of the circuit board 64 contacting the cartridge-attachment portion 110. Further, even if the circuit board 64 were to contact the cartridge-attachment portion 110, the circuit board 64 would not receive a direct impact in the front-rear direction on its surface.

In the present embodiment, the leaf spring 68 enables the circuit board 64 to move vertically. Accordingly, even if the circuit board 64 were to contact the cartridge-attachment portion 110 as the ink cartridge 30 is being inserted into the cartridge-attachment portion 110, the circuit board 64 will not receive a direct impact along the front-rear direction on its surface, and the leaf spring 68 can absorb any impact transmitted from the cartridge-attachment portion 110 to the circuit board 64.

According to the present embodiment, the leaf spring 68 can easily be formed integrally with the housing 31.

In the present embodiment, the leaf spring 68 extends forward from the proximal end 83 that is connected to the housing 31. Hence, the front end of the leaf spring 68 can resiliently deform in the vertical direction.

During the process of inserting the ink cartridge 30 into the cartridge-attachment portion 110 in the present embodiment, a part of the cartridge-attachment portion 110 contacts the sloped surface 68A of the leaf spring 68 and is guided along the sloped surface 68A, resulting in smooth resilient deformation of the leaf spring 68.

Further, the engagement of the sloped surface on the circuit board 64 that is formed to face diagonally upward and rearward and the contacts 132 on the printer 10 in the present embodiment restricts the ink cartridge 30 from being pulled rearward, thereby retaining the ink cartridge 30 in the cartridge-attachment portion 110. Further, arranging the circuit board 64 so as to face in the direction opposite the insertion direction (rearward) can reduce the potential for the circuit board 64 colliding with the cartridge-attachment portion 110 as the ink cartridge 30 is inserted in the insertion direction (forward).

Further, the electrodes 65 and contacts 132 vertically overlap each other when the ink cartridge 30 is mounted in the cartridge-attachment portion 110 in the present embodiment. That is, the electrodes 65 and contacts 132 are aligned with each other in the vertical direction when the ink cartridge 30 is mounted in the cartridge-attachment portion 110. Therefore, most of the vertical resilient force generated by the leaf spring 68 can be applied to the contacts 132 of the printer 10 via the electrodes 65, ensuring that the electrodes 65 firmly contact the contacts 132 of the printer 10.

In the present embodiment, the projection 67 is positioned lower than the circuit board 64. With this arrangement, the circuit board 64 can prevent a direct impact to the projection 67 and the leaf spring 68 supporting the circuit board 64 absorbs the impact if the ink cartridge 30 is dropped onto its top side. The projection 67 is also positioned farther forward than the circuit board 64 in the present embodiment. This arrangement can prevent the member that irradiates light toward the projection 67 (the optical sensor 113 provided in the cartridge-attachment portion 110, for example) and the like from contacting the circuit board 64 as the ink cartridge 30 is being mounted in the cartridge-attachment portion 110.

In the present embodiment, the coil spring 80 can soften impacts in the front-rear direction on the ink cartridge 30.

In the present embodiment, the contacts 132 of the printer 10 are interposed between the front wall 137 and rear wall 136. However, the circuit board 64 in the present embodiment can be moved vertically relative to the cartridge holder 101 by the leaf spring 68. Hence, despite the presence of the front wall 137 and rear wall 136, the circuit board 64 can be moved to a position at which the electrodes 65 contact the contacts 132 of the printer 10 during the process of inserting the ink cartridge 30 into the cartridge-attachment portion 110.

In the present embodiment, the distal end 84 of the leaf spring 68 is positioned farther forward than the circuit board 64. Hence, the leaf spring 68 contacts the cartridge-attachment portion 110 before the circuit board 64 contacts the cartridge-attachment portion 110 while the ink cartridge 30 is being mounted in the cartridge-attachment portion 110. Therefore, the leaf spring 68 can absorb this impact while resiliently deforming in order to mitigate the effects of this impact on the circuit board 64.

In the present embodiment, the cartridge-attachment portion 110 contacts the rubber sealing member 76 prior to contacting the circuit board 64 during the process of mounting the ink cartridge 30 in the cartridge-attachment portion 110. This contact reduces the speed at which the ink cartridge 30 is inserted and can soften the force of impact to the circuit board 64.

First Modification

In the embodiment described above, the circuit board 64 is supported by the leaf spring 68, which is a member that moves through resilient deformation. However, the circuit board 64 may be supported by a member that does not move through resilient deformation. Alternatively, the circuit board 64 may be made movable by supporting the member that supports the circuit board 64 with another member that resiliently deforms. Further, the leaf spring 68 and circuit board 64 in the embodiment described above are capable of moving along the directions in which the leaf spring 68 resiliently deforms (directions indicated by the arrow 69 in FIG. 7 and the arrow 70 in FIG. 9). However, the leaf spring 68 and circuit board 64 may be configured to move in directions other than those indicated by the arrows 69 and 70, such as directions following the direction of gravity. Further, while the circuit board 64 faces in an oblique direction in the embodiment described above, the circuit board 64 may instead face directly upward. In other words, the circuit board 64 may be arranged orthogonal to the direction of gravity.

Figure 12:
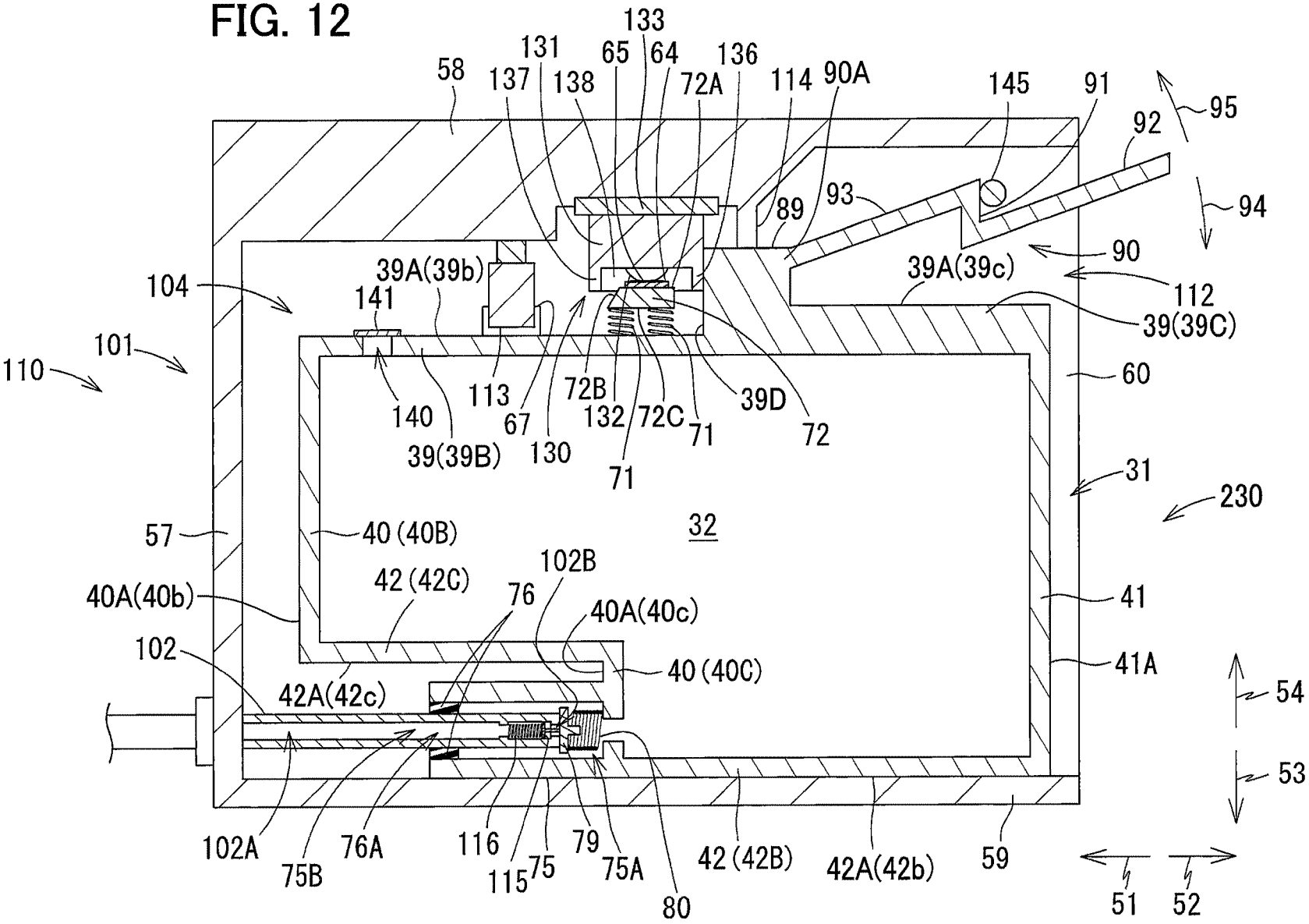
FIG. 12 is a vertical cross-sectional view of an ink cartridge according to a first modification to the embodiment attached to the cartridge-attachment portion.

FIG. 12 illustrates the structure of an ink cartridge 230 according to a first modification of the embodiment in which the ink cartridge 230 is provided with coil springs 71 and a support plate 72 in place of the leaf spring 68 used in the configuration of FIG. 4. The support plate 72 is a plate-shaped member having a top surface 72A that extends in the left-right and front-rear directions, a front surface 72B that faces at least in the frontward direction, and a bottom surface 72C on the opposite side of the top surface 72A and that extends in the left-right and front-rear directions.

One end of each coil spring 71 is connected to the top surface 39*b* of the top wall 39, and the other end is connected to the bottom surface 72C of the support plate 72. Hence, the support plate 72 is supported on the top wall 39 through the coil springs 71. The support plate 72 is arranged so as to extend in the front-rear and left-right directions. Consequently, the top surface 72A of the support plate 72 faces directly upward. The circuit board 64 is bonded to the top surface 72A. Hence, both the circuit board 64 and electrodes 65 (also see FIG. 3) also face directly upward. The front surface 72B of the support plate 72 faces diagonally upward and forward. The memory 66 is mounted on the substrate 64, but is not illustrated in FIG. 12.

When the ink cartridge 230 is inserted forward into the cartridge holder 101, the front surface 72B of the support plate 72 contacts the rear wall 136 of the connector 130 in the cartridge-attachment portion 110 from the rear side. The rear wall 136 is guided along the front surface 72B. After passing over the front surface 72B, the rear wall 136 is guided along the top surface 72A of the support plate 72 and the circuit board 64. During the process of guiding the rear wall 136, the support plate 72 is resiliently deformed in the direction of gravity against the urging force of the coil springs 71 due to the reaction force from the rear wall 136. Consequently, the support plate 72 and circuit board 64 move in the direction of gravity relative to the housing 31 of the ink cartridge 230.

As the ink cartridge 230 is inserted farther into the cartridge holder 101, the support plate 72 moves to a position farther forward than the rear wall 136. At this time, the urging force of the coil springs 71 moves the support plate 72 upward. Consequently, the electrodes 65 on the circuit board 64 contact the contacts 132 from below.

In the first modification, the coil springs 71 serve as resilient members for supporting the support plate 72. However, resilient members for supporting the support plate 72 are not limited to the coil springs 71, but may be leaf springs or torsion coil springs, for example.

Since the first modification does not require that the resilient members directly support the circuit board 64, members of various shapes and materials (the coil springs 71, for example) may be employed as the resilient members.

Since the support plate 72 can move vertically in the first modification, most of the upward resilient force produced by the coil springs 71 can be applied to the contacts 132 via the electrodes 65. Accordingly, the electrodes 65 can be made to contact the contacts 132 firmly.

In the process of inserting the ink cartridge 230 into the cartridge-attachment portion 110 in the first modification, a part of the cartridge-attachment portion 110 contacts the front surface 72B of the support plate 72 and is guided along the front surface 72B, resulting in smooth resilient deformation of the coil springs 71.

In the first modification, the electrodes 65 and the contacts 132 of the printer 10 vertically overlap each other when the ink cartridge 230 is mounted in the cartridge-attachment portion 110. That is, each of the electrodes 65 is aligned with the corresponding contact 132 of the printer 10 in the vertical direction when the ink cartridge 230 is mounted in the cartridge-attachment portion 110. Therefore, most of the upward resilient force produced by the coil springs 71 can be applied to the contacts 132 of the printer 10 via the electrodes 65, ensuring that the electrodes 65 firmly contact the contacts 132.

Second Modification

Figure 13:
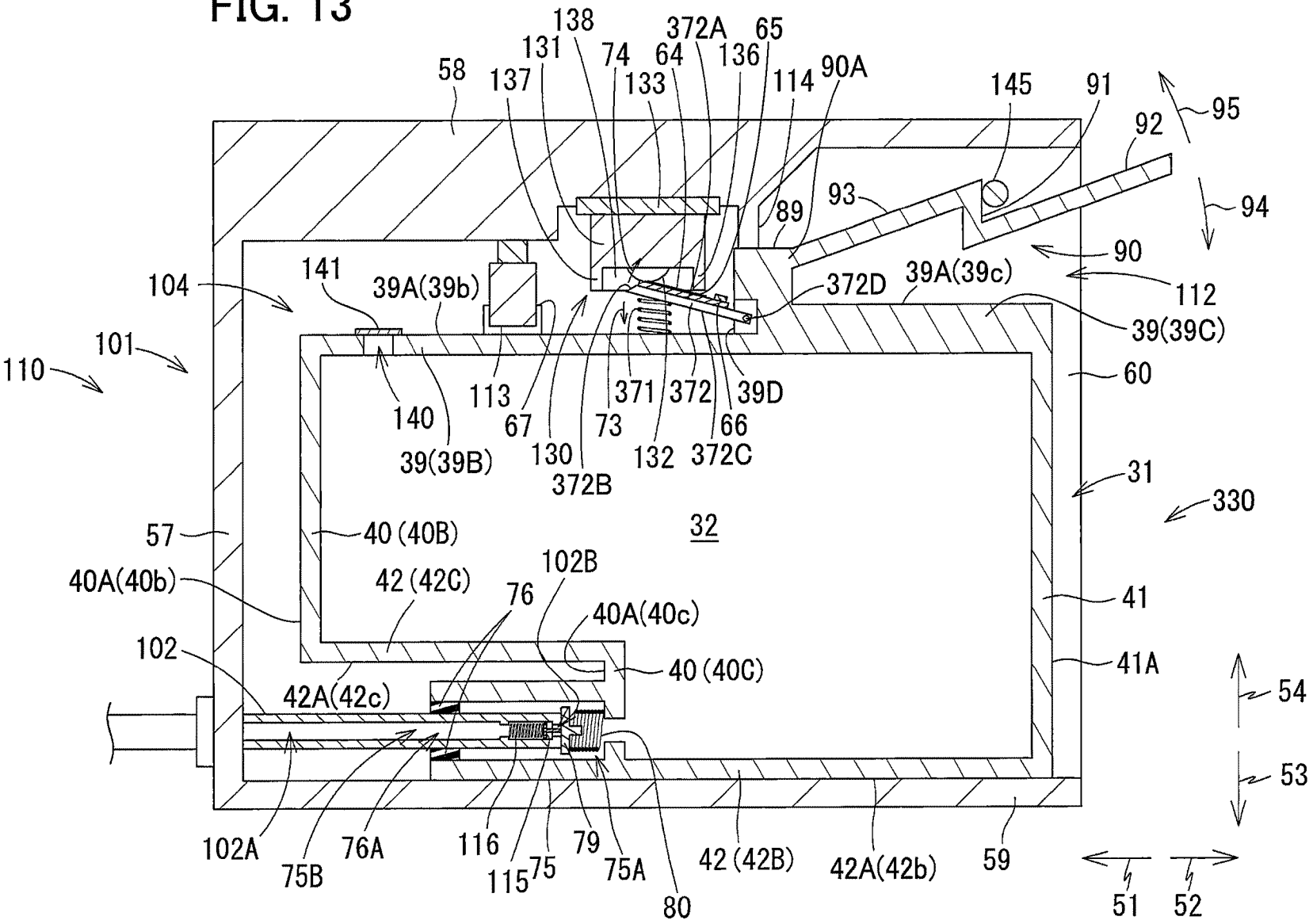
FIG. 13 is a vertical cross-sectional view of an ink cartridge according to a second modification to the embodiment attached to the cartridge-attachment portion.

In the first modification described above, the support plate 72 moves vertically. However, the support plate 72 may also pivot, as in a second modification illustrated in FIG. 13. FIG. 13 illustrates the structure of an ink cartridge 330 according to the second modification of the embodiment in which the ink cartridge 330 is provided with a coil spring 371 and a support plate 372 in place of the leaf spring 68 used in the configuration of FIG. 4. In this modification, the support plate 372 is pivotably supported by the top wall 39 about a pivotal shaft 372D that extends in the left-right direction. The support plate 372 slopes relative to the front-rear direction, and specifically, slopes upward toward the front. The coil spring 371 is disposed at a position forward of the pivotal shaft 372D, with one end of the coil spring 371 connected to the top surface 39*b* of the top wall 39 and the other end connected to a bottom surface 372C of the support plate 372.

When the ink cartridge 330 is inserted forward into the cartridge holder 101, the front surface 372B of the support plate 372 contacts the rear wall 136 of the connector 130 in the cartridge-attachment portion 110 from the rear side. The rear wall 136 is guided along the front surface 372B of the support plate 372. After passing over the front surface 372B, the rear wall 136 is guided along a top surface 372A of the support plate 372 and the circuit board 64. Through the process of guiding the rear wall 136, the support plate 372 is pivoted in a direction indicated by an arrow 73 in FIG. 13 against the urging force of the coil spring 371 in response to the reaction force from the rear wall 136.

As the ink cartridge 330 is inserted farther into the cartridge holder 101, the front surface 372B of the support plate 372 moves to a position farther forward than the rear wall 136. At this time, the urging force of the coil spring 371 moves the support plate 372 in a direction indicated by an arrow 74 in FIG. 13. Consequently, the electrodes 65 on the circuit board 64 contact the contacts 132 from below.

In the second modification, the coil spring 371 serves as a resilient member for supporting the support plate 372. However, the resilient member supporting the support plate 372 is not limited to the coil spring 371, but may be a leaf spring or torsion spring, for example.

The second modification described above can facilitate implementation of a structure used to move the circuit board 64.

Third Modification

Figure 14:
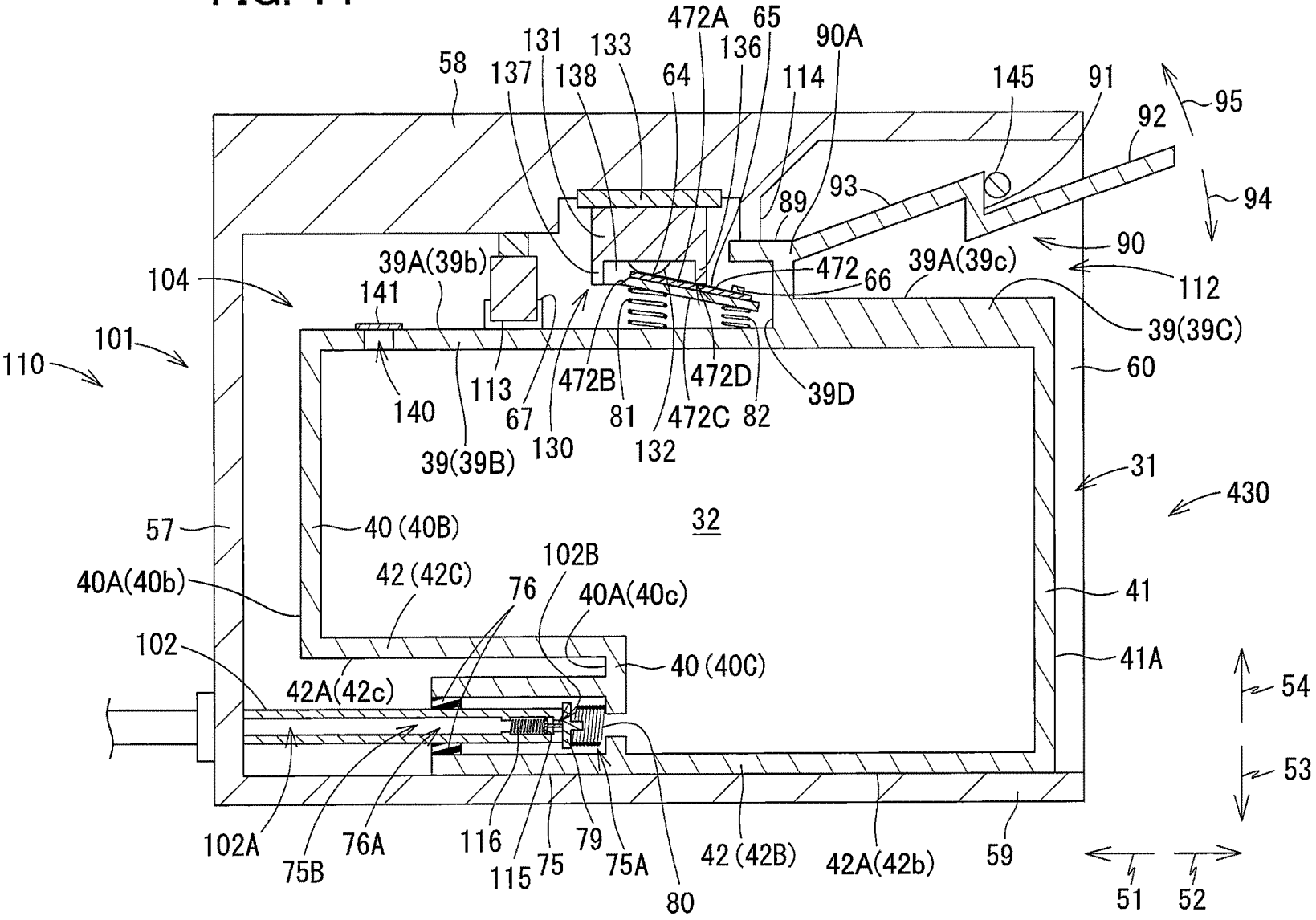
FIG. 14 is a vertical cross-sectional view of an ink cartridge according to a third modification to the embodiment attached to the cartridge-attachment portion.

FIG. 14 illustrates the structure of an ink cartridge 430 according to a third modification of the embodiment. In the structure of FIG. 14, the ink cartridge 430 is provided with a support plate 472, a first coil spring 81, and a second coil spring 82 in place of the leaf spring 68 used in the structure of FIG. 4.

The support plate 472 has the same configuration as the support plate 72 in the first modification. However, the support plate 472 in the third modification slopes relative to the front-rear direction so that the front end is higher than the rear end. The circuit board 64 is bonded to a top surface 472A of the support plate 472. Hence, the top surface 472A supports the circuit board 64.

One end of the first coil spring 81 is connected to the top surface 39A of the top wall 39, and the other end is connected to the front portion of the support plate 472 on a bottom surface 472C of the same. The bottom surface 472C is the surface on the opposite side of the support plate 472 from the top surface 472A. The second coil spring 82 is shorter than the first coil spring 81. One end of the second coil spring 82 is connected to the top surface 39A of the top wall 39 at a position rearward of the position at which the first coil spring 81 is connected, while the other end of the second coil spring 82 is connected to the rear portion of the support plate 472 on the bottom surface 472C thereof.

When the ink cartridge 430 is inserted forward into the cartridge holder 101, the front surface 472B of the support plate 472 contacts the rear wall 136 of the connector 130 in the cartridge-attachment portion 110 from a position diagonally below and rearward of the same. The rear wall 136 is guided along the front surface 472B. During the process of guiding the rear wall 136, the support plate 472 is pivoted about its rear edge against the urging force of the first coil spring 81 by a reaction force from the rear wall 136 so that the front edge of the support plate 472 moves downward.

As the ink cartridge 430 is inserted farther into the cartridge holder 101, the front surface 472B moves to a position forward of the rear wall 136. From this point, the rear wall 136 is guided along the top surface 472A of the support plate 472 and the circuit board 64. In other words, the top surface 472A and the circuit board 64 contact the rear wall 136 from below. At this time, the first coil spring 81 is positioned forward of the rear wall 136 and the second coil spring 82 is positioned rearward of the rear wall 136. Also at this time, the support plate 472 is pivoted about a contact part 472D, which is the part of the support plate 472 in contact with the rear wall 136. Specifically, the front part of the support plate 472 is moved upward by the urging force of the first coil spring 81, while the rear part is moved downward by the urging force of the second coil spring 82. Accordingly, the electrodes 65 on the circuit board 64 contact the contacts 132 from below. The state of the ink cartridge 430 at this time is the attached state.

In the attached state, the front portion of the support plate 472 that is farther forward than the contact part 472D contacting the rear wall 136 is higher than the contact part 472D. This front portion is connected to the top wall 39 via the first coil spring 81. Also in the attached state, the rear portion of the support plate 472 that is farther rearward than the contact part 472D is lower than the contact part 472D. This rear portion is connected to the top wall 39 via the second coil spring 82.

Note that the lengths and spring coefficients of the first coil spring 81 and second coil spring 82 are suitably set to attain the pivot of the support plate 472 described above.

In the third modification, the coil springs 81 and 82 serve as resilient members for supporting the support plate 472. However, the resilient members supporting the support plate 472 are not limited to the coil springs 81 and 82, but may be configured of leaf springs or torsion coil springs, for example.

In the third modification described above, the support plate 472 can be pivoted about the contact part 472D at which the support plate 472 contacts the rear wall 136.

Fourth Modification

Figure 15:
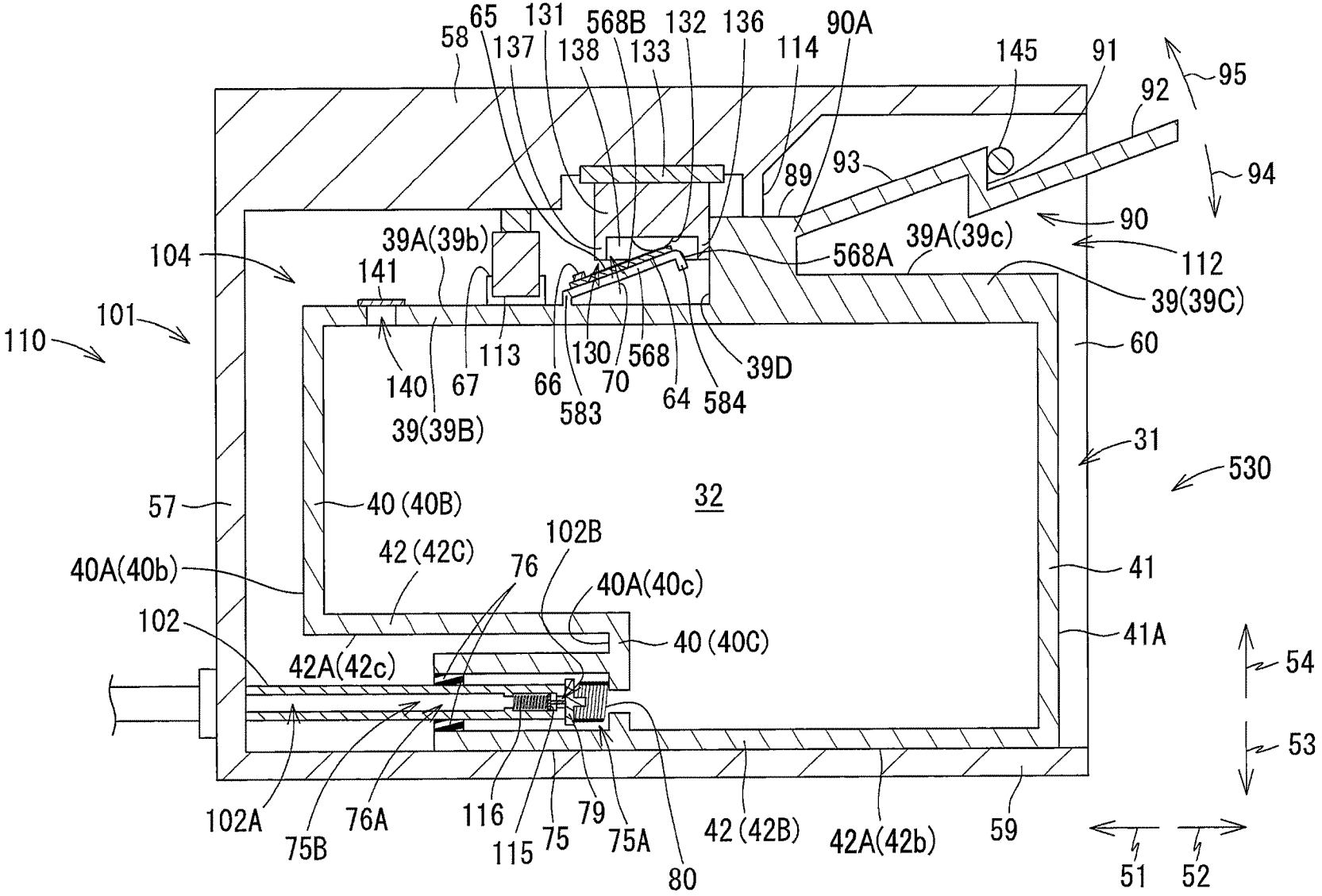
FIG. 15 is a vertical cross-sectional view of an ink cartridge according to a fourth modification to the embodiment attached to the cartridge-attachment portion.

In the embodiment and the second and third modifications described above, the leaf spring 68 (see FIG. 4) and the support plates 372 and 472 (see FIGS. 13 and 14) slope relative to the front-rear direction so that the front end is higher than the rear end. However, the leaf spring 68 and support plates 372 and 472 may be sloped relative to the front-rear direction so that their rear ends are higher than their front ends. FIG. 15 illustrates the structure of an ink cartridge 530 according to a fourth modification of the embodiment in which a leaf spring 568 extends diagonally upward and rearward from the proximal end 583 on the top surface 39*b* of the top wall 39 toward the distal end 584.

When the ink cartridge 530 is inserted forward into the cartridge holder 101 in this modification, a top surface 568B of the leaf spring 568 and the circuit board 64 contact the rear wall 136 of the connector 130 from the rear side. The rear wall 136 is guided along the top surface 568B of the leaf spring 568 and the circuit board 64. During this process of guiding the rear wall 136, the leaf spring 568 resiliently deforms in the direction of gravity in response to the reaction force from the rear wall 136.

As the ink cartridge 530 is inserted farther into the cartridge holder 101, the leaf spring 568 moves to a position forward of the rear wall 136. At this time, the leaf spring 568 returns resiliently upward, and the electrodes 65 on the circuit board 64 contact the contacts 132 from below.

During the process of pulling the ink cartridge 530 rearward from the cartridge holder 101, a sloped surface 568A of the leaf spring 568 contacts the rear wall 136 from the front side. The rear wall 136 is guided along the sloped surface 568A. After passing over the sloped surface 568A, the rear wall 136 is guided along the top surface 568B of the leaf spring 568 and the circuit board 64. Through the process of guiding the rear wall 136, the leaf spring 568 resiliently deforms in the direction of gravity in response to the reaction force from the rear wall 136.

As the ink cartridge 530 is pulled farther out of the cartridge holder 101, the leaf spring 568 moves to a position rearward of the rear wall 136. At this time, the leaf spring 568 elastically returns upward to its original state.

Other Variations

Figure 16:
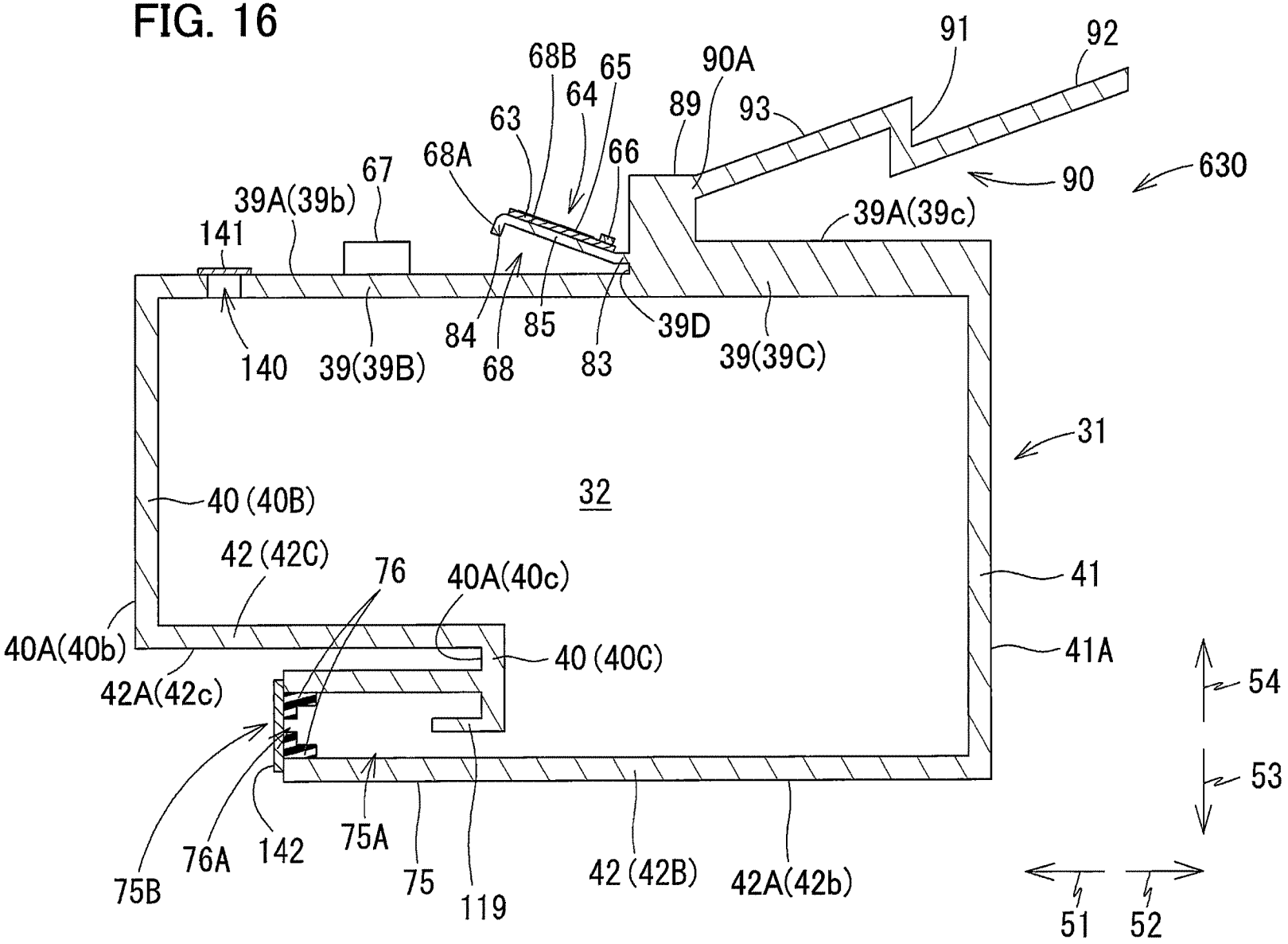
FIG. 16 is a vertical cross-sectional view of an ink cartridge according to a variation of the embodiment.

In an ink cartridge 630 according to a variation of the embodiment, as illustrated in FIG. 16, the cylinder 75 may be closed by affixing a seal 142 to the cylinder 75. In this case, a projection 119 may be formed in the passage 75A in place of the valve 79 and coil spring 80. As the ink cartridge 630 is being inserted into the cartridge holder 101, the projection 119 contacts the valve 115 from the rear side (see FIG. 2) and pushes the valve 115 forward. As a result, the valve 115 moves forward against the urging force of the coil spring 116, thereby allowing communication between the interior space 102A of the tube 102 and the outside of the tube 102.

In the embodiment described above, the ink cartridge 30 is inserted along the front-rear direction into the cartridge holder 101 of the cartridge-attachment portion 110. However, the insertion direction of the ink cartridge 30 is not limited to the front-rear direction. For example, the ink cartridge 30 may be pivoted inside the cartridge holder 101 during the insertion process. In this case, the ink cartridge 30 is pivoted so that the ink cartridge 30 is engaged with a locking member provided in the cartridge holder 101 (such as the shaft 145 in the embodiment described above).

In the embodiment described above, the ink cartridge 30 is fixed in the front-rear direction by the engaging surface 91 of the locking lever 90 contacting the shaft 134 from the front side thereof. However, the positioning means for the ink cartridge 30 is not limited to this engagement between the locking lever 90 and shaft 145. For example, the ink cartridge 30 may be fixed in the front-rear direction through sliding resistance between the protruding part 89 of the ink cartridge 30 and the bottom surface on the protruding part 114 of the cartridge-attachment portion 110, and sliding resistance between the bottom surface 42A of the ink cartridge 30 and the inner top surface on the bottom wall 59 of the cartridge-attachment portion 110. Alternatively, the ink cartridge 30 may be fixed in the front-rear direction through sliding resistance between the sealing member 76 of the ink cartridge 30 and the tube 102 of the cartridge-attachment portion 110, for example.

In the embodiment described above, the entirety of the electrodes 65 overlaps the leaf spring 68 when viewed along the direction of gravity. In other words, each of the electrodes 65 is aligned with the leaf spring 68 in the vertical direction. However, the ink cartridge 30 may be configured so that only a portion of the electrodes 65 overlaps the leaf spring 68 in the direction of gravity or that the electrodes 65 and leaf spring 68 do not overlap in the direction of gravity. For example, by arranging the circuit board 64 so that a portion of the circuit board 64 protrudes farther forward than the distal edge of the leaf spring 68 and by forming the electrodes 65 on this protruding portion of the circuit board 64, the electrodes 65 can be configured either to partially overlap the leaf spring 68 when viewed in the direction of gravity or not to overlap the leaf spring 68 at all.

Figure 17:
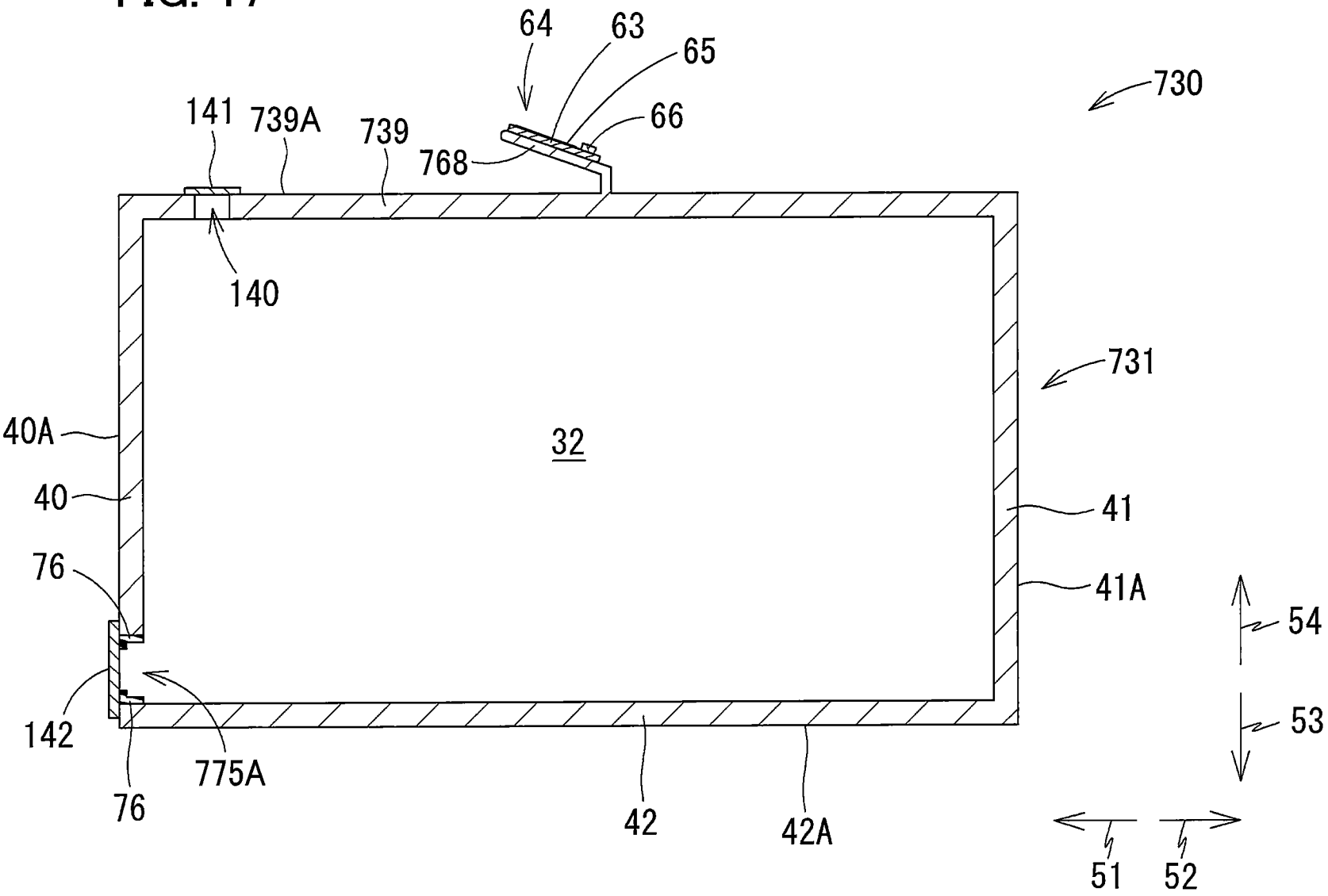
FIG. 17 is a vertical cross-sectional view of an ink cartridge according to another variation of the embodiment.

The ink cartridges 30, 230, 330, 430, 530, and 630 are not limited to the structures illustrated in FIGS. 4, 5, and 12 through 16. For example, FIG. 17 illustrates the structure of an ink cartridge 730 according to another variation of the embodiment. In the structure illustrated in FIG. 17, the ink cartridge 730 includes a housing 731 having a substantially rectangular parallelepiped shape. The ink cartridge 730 is not provided with the projection 67, protruding part 89, locking lever 90, cylinder 75, and the like. The passage 775A is closed by the seal 142. Further, rather than forming the sloped surface 68A on the leaf spring 68 as in the embodiment, the distal edge of a leaf spring 768 provided in the ink cartridge 730 is rounded in the structure illustrated in FIG. 17. Also, a top wall 739 is not formed with the stepped surface 39D provided in the embodiment described above. Thus, the leaf spring 768 may be configured to protrude from the top surface 739A. Note that the presence of a round in the distal edge of the leaf spring 768 is optional.

As in the embodiment described above, the ink cartridge 730 having the configuration illustrated in FIG. 17 is inserted along the front-rear direction into the cartridge holder 101 of the cartridge-attachment portion 110. As in the embodiment described above, the seal 141 is peeled off the ink cartridge 730 prior to inserting the ink cartridge 730, and the tube 102 in the cartridge-attachment portion 110 punctures the seal 142 during the process of insertion. Resilient deformation of the leaf spring 768 during the process of insertion and contact between the electrodes 65 and contacts 132 are identical to those described in the embodiment.

In the embodiment described above, ink is described as an example of liquid, but the liquid cartridge may store a liquid other than ink, such as a pretreatment liquid that is ejected onto sheets or the like prior to ink during a printing operation, or water for cleaning the recording head 21.

It should be apparent to those who skilled in the art that the embodiment, various modifications thereto and variations described above may be combined with one another as appropriate.

<Remarks>

The ink cartridges 30, 230, 330, 430, 530, 630, and 730 are the example of the liquid cartridge. The cartridge-attachment portion 110 is an example of the attachment portion. The contacts 132 are an example of the contact of the device. The printer 10 is an example of the printing device. The housings 31 and 731 are an example of the housing. The storage chamber 32 is an example of the liquid chamber. The passages 75A and 775A are an example of the liquid passage. The sealing member 76 is an example of the sealing member. The circuit board 64 is an example of the circuit board. The electrodes 65 are an example of the contact of the cartridge. The memory 66 is an example of the memory. The substrate 63 is an example of the substrate. The leaf springs 68, 568 and 768 and support plates 72, 372 and 472 are an example of the support member. The top surfaces 72A, 372A and 472A are an example of the first surface. The bottom surfaces 52C, 372C and 472C are an example of the second surface. The pivotal shaft 372D and contact part 472D are an example of the pivot axis. The coil springs 71, 81, 82 and 371 are an example of the resilient member. The protrusion 67 is an example of the plate. The front surface 40A is an example of the front surface. The rear surface 41A is an example of the rear surface. The top surface 39A is an example of the upper surface. The bottom surface 42A is an example of the lower surface. The coil spring 80 is an example of the urging member. The cartridge holder 101 is an example of the holder. The tubes 102 are an example of the tube. The connectors 130 are an example of the connector. The front wall 137 is an example of the first wall. The rear wall 136 is an example of the wall and the second wall.

What is claimed is:

1. A liquid cartridge configured to be inserted into an attachment portion of a printing device in an insertion direction crossing a gravitational direction and attached to the attachment portion in an upright posture, the attachment portion including a contact, the liquid cartridge comprising:

a housing comprising:

a liquid chamber storing liquid therein; and a liquid passage in communication with the liquid chamber and extending forward in the insertion direction from the liquid chamber, the liquid passage having a front end in the insertion direction, an opening being formed in the front end;

a sealing member disposed in the liquid passage;

a circuit board positioned rearward in the insertion direction relative to the sealing member in the upright posture, the circuit board comprising:

a contact facing at least upward in the upright posture, the contact of the cartridge being electrically connectable to the contact of the device; and a memory electrically connected to the contact of the cartridge; and a support member supporting the circuit board, the circuit board supported by the support member being resiliently movable upward and downward relative to the housing in the upright posture.

2. The liquid cartridge according to claim 1, wherein the support member has a proximal end portion connected to the housing, a distal end portion opposite to the proximal end portion, and a support surface extending from the proximal end portion toward the distal end portion, the circuit board being supported on the support surface.

3. The liquid cartridge according to claim 2, wherein the support member is a leaf spring resiliently deformable in a vertical direction in the upright posture.

4. The liquid cartridge according to claim 3, wherein the distal end portion has a sloped surface sloped obliquely downward with respect to the insertion direction in the upright posture.

5. The liquid cartridge according to claim 4, wherein the distal end portion is positioned forward in the insertion direction relative to the support surface in the upright posture, and the sloped surface faces upward and forward in the insertion direction in the upright posture.

6. The liquid cartridge according to claim 4, wherein the distal end portion is positioned rearward in the insertion direction relative to the support surface in the upright posture, and the sloped surface faces upward and rearward in the insertion direction in the upright posture.

7. The liquid cartridge according to claim 1, further comprising a resilient member connecting the support member to the housing.

8. The liquid cartridge according to claim 7, wherein the resilient member is a coil spring.

9. The liquid cartridge according to claim 7, wherein the support member is movable in the vertical direction relative to the housing in the upright posture.

10. The liquid cartridge according to claim 7, wherein the support member is pivotably supported by the housing about a pivot axis extending in a widthwise direction perpendicular to the insertion direction and the gravitational direction, the resilient member connecting the support member and the housing at a position forward in the insertion direction relative to the pivot axis in the upright posture.

11. The liquid cartridge according to claim 7, wherein the support member has a first surface supporting the circuit board and a second surface opposite to the first surface, and wherein the resilient member comprises:

a first coil spring having one end and another end, the one end of the first coil spring being connected to the housing, the another end of the first coil spring being connected to the second surface; and a second coil spring positioned rearward in the insertion direction relative to the first coil spring in the upright posture, the second coil spring having one end and another end, the one end of the second coil spring being connected to the housing, the another end of the second coil spring being connected to the second surface.

12. The liquid cartridge according to claim 11, wherein the attachment portion includes a wall having a lower end in the gravitational direction in the upright posture, the lower end being positioned downward and rearward in the insertion direction relative to the contact of the device, wherein the support member has a contact part configured to make contact with the lower end of the wall from below in the upright posture, wherein the first coil spring connects the support member and the housing at a position upward and forward in the insertion direction relative to the contact part in the upright posture, and wherein the second coil spring connects the support member and the housing at a position downward and forward in the insertion direction relative to the contact part in the upright posture.

13. The liquid cartridge according to claim 7, wherein the support member has a sloped surface facing upward and forward in the insertion direction in the upright posture.

14. The liquid cartridge according to claim 1, wherein the circuit board comprises a substrate extending perpendicular to the gravitational direction in the upright posture.

15. The liquid cartridge according to claim 1, wherein the circuit board comprises a substrate facing upward and rearward in the insertion direction in the upright posture.

16. The liquid cartridge according to claim 1, wherein the contact of the cartridge comprises a plurality of electrodes arranged to be aligned with one another in a widthwise direction perpendicular to the insertion direction and the gravitational direction in the upright posture.

17. The liquid cartridge according to claim 1, wherein the contact of the cartridge and the support member are partially aligned with each other in the gravitational direction.

18. The liquid cartridge according to claim 1, further comprising a plate positioned downward and forward in the insertion direction relative to the circuit board in the upright posture, the plate having a light-blocking part configured to block or attenuate light.

19. The liquid cartridge according to claim 1, wherein the housing has:

a front surface facing forward in the insertion direction in the upright posture, the opening of the liquid passage being open at the front surface;

a rear surface spaced apart from the front surface in the insertion direction, the rear surface facing rearward in the insertion direction in the upright posture, the liquid chamber being disposed between the front surface and the rear surface in the insertion direction;

an upper surface disposed between the front surface and the rear surface, the upper surface facing upward in the upright posture, the circuit board being provided at the upper surface; and a lower surface disposed between the front surface and the rear surface, the lower surface facing downward in the upright posture, the liquid chamber being disposed between the upper surface and the lower surface in the gravitational direction.

20. The liquid cartridge according to claim 19, further comprising an urging member disposed in the liquid passage and configured to urge the sealing member forward in the insertion direction, the urging member having a rear end in the insertion direction, wherein the circuit board is positioned rearward in the insertion direction relative to the rear end of the urging member.

* * * * *